US010564559B2

(12) United States Patent
Maetani

(10) Patent No.: US 10,564,559 B2
(45) Date of Patent: Feb. 18, 2020

(54) POSITIVELY CHARGEABLE TONER, IMAGE FORMING APPARATUS AND IMAGE FORMING METHOD

(71) Applicant: KYOCERA Document Solutions Inc., Osaka (JP)

(72) Inventor: Ken Maetani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/387,132

(22) Filed: Apr. 17, 2019

(65) Prior Publication Data

US 2019/0332026 A1 Oct. 31, 2019

(30) Foreign Application Priority Data

Apr. 27, 2018 (JP) ..... 2018-086841

(51) Int. Cl.

*G03G 9/093* (2006.01)
*G03G 15/08* (2006.01)
*G03G 9/08* (2006.01)

(52) U.S. Cl.

CPC ..... *G03G 9/09364* (2013.01); *G03G 9/0819* (2013.01); *G03G 9/09328* (2013.01); *G03G 9/09371* (2013.01); *G03G 15/0865* (2013.01)

(58) Field of Classification Search

CPC .. G03G 9/093; G03G 9/0935; G03G 9/09364; G03G 9/09766

See application file for complete search history.

(56) References Cited

U.S. PATENT DOCUMENTS 4,590,142 A * 5/1986 Yamazaki ..... G03G 9/09342 427/213.36
2007/0178397 A1* 8/2007 Yamanouchi ..... G03G 9/0804 430/108.4
2010/0204345 A1* 8/2010 Yamanaka ..... C08F 2/18 514/772.4
2016/0291491 A1* 10/2016 Koyama ..... G03G 9/08755

FOREIGN PATENT DOCUMENTS

JP H01-1883667 * 7/1989 ..... G03G 9/08
JP 2000-098673 A 4/2000

OTHER PUBLICATIONS

Translation of JP H01-1883667.*

* cited by examiner

*Primary Examiner* — Peter L Vajda
(74) *Attorney, Agent, or Firm* — Studebaker & Brackett PC

(57) ABSTRACT

A positively chargeable toner includes toner particles. The toner particles each include a core, a shell layer covering a surface of the core, and fluororesin particles. The fluororesin particles are positioned within the core, or between the core and the shell layer. The shell layer contains a positively chargeable material.

8 Claims, 5 Drawing Sheets

POSITIVELY CHARGEABLE TONER, IMAGE FORMING APPARATUS AND IMAGE FORMING METHOD

INCORPORATION BY REFERENCE

The present application claims priority under 35 U.S.C. § 119 to Japanese Patent Application No. 2018-086841, filed on Apr. 27, 2018. The contents of this application are incorporated herein by reference in their entirety.

BACKGROUND

The present disclosure relates to a positively chargeable toner, an image forming apparatus, and an image forming method.

In an electrophotographic method, a surface of an image bearing member is charged and then exposed to form an electrostatic latent image on the image bearing member. Subsequently, the electrostatic latent image is developed into a toner image with a developer, and the toner image is transferred onto a recording medium. Thereafter, the toner image thus transferred is fixed on the recording medium through heating and pressing by a fixing device. In fixing the toner image on the recording medium, there may occur a phenomenon in which a toner disposed on the recording medium electrostatically moves onto a heating section of the fixing device (electrostatic offset). Electrostatic offset tends to be easily caused particularly when an image is formed using a positively chargeable toner. In order to inhibit occurrence of electrostatic offset, an example of an image forming apparatus employs a structure in which a bias is applied to a fixing member of a fixing device.

SUMMARY

A positively chargeable toner according to the present disclosure includes toner particles. The toner particles each include a core, a shell layer covering a surface of the core, and fluororesin particles. The fluororesin particles are positioned within the core, or between the core and the shell layer. The shell layer contains a positively chargeable material.

An image forming apparatus according to the present disclosure includes an image bearing member, a developing device, a transfer device, and a fixing device. The developing device develops, with a developer, an electrostatic latent image formed on the image bearing member into a toner image. The transfer device transfers the toner image onto a recording medium. The fixing device fixes the transferred toner image on the recording medium. The developer contains the above-described positively chargeable toner.

An image forming method according to the present disclosure includes developing, with a developer, an electrostatic latent image formed on an image bearing member into a toner image, transferring the toner image onto a recording medium, and fixing the transferred toner image on the recording medium. The developer contains the above-described positively chargeable toner.

DETAILED DESCRIPTION

First, meaning of terms and measurement methods employed herein will be described. An evaluation result (a value corresponding to a shape, a property or the like) regarding a powder (of, more specifically, toner mother particles, cores, an external additive, fluororesin particles, or a positively chargeable toner) is a number average of measured values of a considerable number of particles contained in the powder unless otherwise defined.

Each of the particle diameter and the number average primary particle diameter of a powder refers to a number average value of equivalent circle diameters (Heywood diameters: diameters each of a circle having the same area as projected area of each particle) of primary particles measured under a microscope unless otherwise defined.

A volume median diameter ($D_{50}$) of a powder refers to a value measured based on Coulter principle (pore electrical resistance method) using "COULTER COUNTER MULTISIZER 3" manufactured by Beckmann Coulter, Inc. unless otherwise defined. Hereinafter, the "volume median diameter" is sometimes referred to as the "$D_{50}$".

The extent of chargeability refers to triboelectric charging behavior against a standard carrier available from The Imaging Society of Japan unless otherwise defined. For example, a measurement target is stirred together with a standard carrier (anionic carrier: N-01, cationic carrier: P-01) available from The Imaging Society of Japan to triboelectrically charging the measurement target. The surface potential of the measurement target is measured with, for example, a Q/m meter ("MODEL 212HS" manufactured by Trek, Inc.) before and after the triboelectric charging, and a larger change in the potential between before and after the triboelectric charging means that the measurement target has higher chargeability.

Herein, the term "-based" is sometimes used behind a name of a compound to comprehensively generically indicate the compound and derivatives thereof. When the term "-based" is used behind a name of a compound to indicate a name of a polymer, it means that a repeating unit of the polymer derives from the compound or a derivative thereof. Besides, acryl and methacryl are sometimes comprehensively generically referred to as "(meth)acryl". Acrylonitrile and methacrylonitrile are sometimes comprehensively generically referred to as "(meth)acrylonitrile". The meaning of the terms and the measurement method employed herein have been described so far. Next, embodiments of the present disclosure will be described.

First Embodiment: Positively Chargeable Toner

A positively chargeable toner (hereinafter sometimes referred to as the toner) according to a first embodiment will be described. The toner of the first embodiment includes toner particles. The toner is a collection (a powder) of the toner particles.

Figure 1:
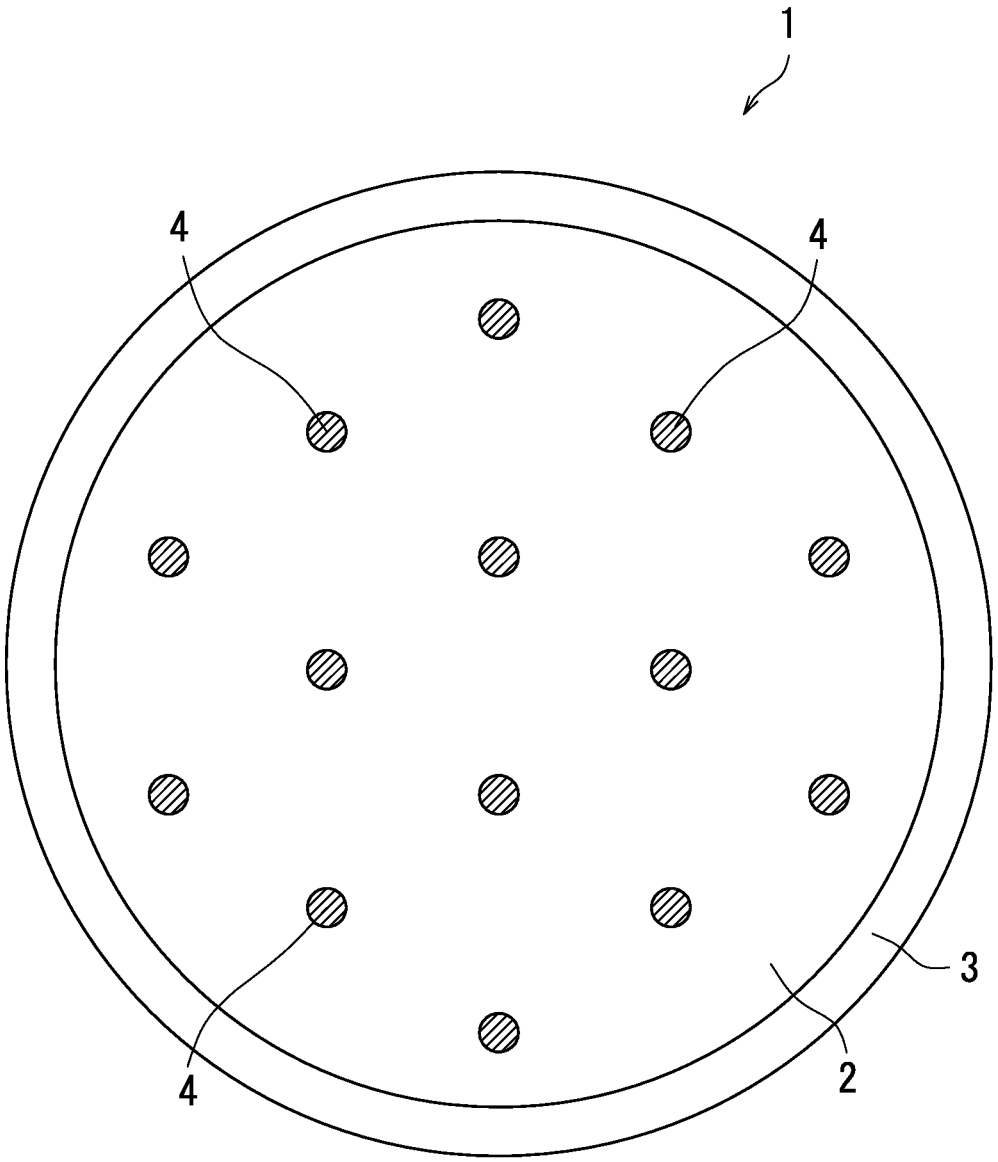
FIG. 1 is a diagram illustrating an example of a cross-sectional structure of a toner particle, the toner particle being contained in a positively chargeable toner according to a first embodiment of the present disclosure.

Now, an example of the structure of a toner particle 1 will be described referring to FIG. 1. FIG. 1 illustrates an example of the cross-sectional structure of the toner particle 1. The toner particle 1 includes a core 2, a shell layer 3, and fluororesin particles 4. The shell layer 3 covers the surface of the core 2. The shell layer 3 is provided on the surface of the core 2. The fluororesin particles 4 are positioned within the core 2. The shell layer 3 contains a positively chargeable material.

Figure 2:
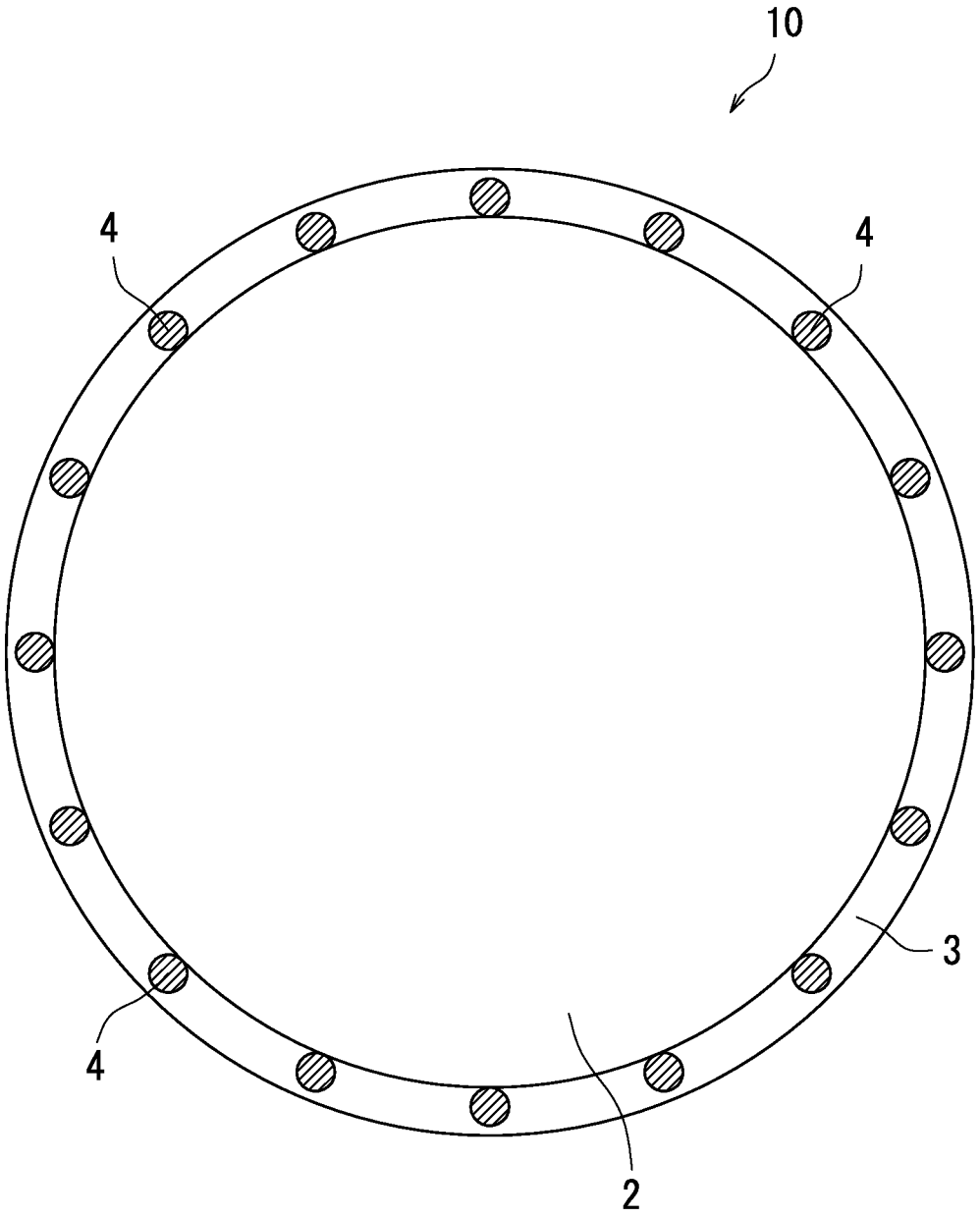
FIG. 2 is a diagram illustrating another example of the cross-sectional structure of the toner particle, the toner particle being contained in the positively chargeable toner according to the first embodiment of the present disclosure.

Next, the structure of a toner particle 10 of another example will be described referring to FIG. 2. FIG. 2 illustrates the cross-sectional structure of the toner particle 10 of another example. The toner particle 10 includes a core 2, a shell layer 3, and fluororesin particles 4. The shell layer 3 covers the surface of the core 2. The shell layer 3 is provided on the surface of the core 2. Each of the fluororesin particles 4 is positioned between the core 2 and the shell layer 3. Specifically, the fluororesin particles 4 are positioned between the surface of the core 2 and a surface of the shell layer 3 close to the core 2 (on the interface). The shell layer 3 contains a positively chargeable material.

The toner of the first embodiment may include merely either or both of the toner particles 1 of FIG. 1 and the toner particles 10 of FIG. 2. It is noted that the toner of the first embodiment may include another type of toner particles in addition to the toner particles 1 and the toner particles 10. In the toner of the first embodiment, in order to further inhibit occurrence of electrostatic offset, a total content of the toner particles 1 and the toner particles 10 in all the toner particles is preferably 80% by mass or more, more preferably 90% by mass or more, and particularly preferably 100% by mass. In order to obtain a toner suitably used for image formation, the $D_{50}$ of the toner particles 1 and the toner particles 10 is preferably 4 μm or more and 9 μm or less.

The toner particles 1 and the toner particles 10 neither including an external additive have been described above for simplifying the description. The toner particles included in the toner of the first embodiment may, however, further include external additive particles (not shown). For example, the toner particles 1 of FIG. 1 or the toner particles 10 of FIG. 2 are used as toner mother particles. The toner particles included in the toner of the first embodiment may each include the toner mother particle, and external additive particles provided on the surface of the toner mother particle. The structures of the toner particles have been thus described referring to FIGS. 1 and 2.

The toner of the first embodiment can inhibit occurrence of electrostatic offset as well as attain good positive chargeability. This is probably for the following reason:

Each of the toner particles included in the toner of the first embodiment includes the fluororesin particles, and the fluororesin particles are positioned within the core or between the core and the shell layer. The fluororesin particles tend to have negative chargeability. A surface portion of a heating section of a fixing device contains a negatively chargeable resin such as a fluororesin. In fixing the toner of the first embodiment, the toner is heated and pressed by the fixing device, and hence the fluororesin particles enclosed in the toner particle are exposed. The thus exposed fluororesin particles tend to electrostatically repel the surface (a surface of the surface portion) of the heating section. Therefore, the toner including the fluororesin particles disposed on a recording medium can be inhibited from moving onto the heating section through electrostatic attraction to the heating section of the fixing device. In this manner, occurrence of electrostatic offset can be inhibited by the toner of the first embodiment.

Besides, in the toner of the first embodiment, the shell layer contains the positively chargeable material. Therefore, the toner can be provided with good positive chargeability. Furthermore, as described above, each of the toner particles included in the toner of the first embodiment includes the fluororesin particles, and the fluororesin particles are positioned within the core or between the core and the shell layer. Since the negatively chargeable fluororesin particles are not exposed on the surface of the toner particle but enclosed in the toner particle, the good positive chargeability of the toner is retained. The term "good positive chargeability" herein comprehensively means that a positive charge amount of the toner before making a large number of copies is equal to or larger than a desired value, that the positive charge amount of the toner after making a large number of copies is equal to or larger than a desired value, and that a change in the charge amount of the toner between before and after making a large number of copies is equal to or lower than a desired value.

When the toner of the first embodiment is used, occurrence of electrostatic offset can be inhibited without changing the structure of an image forming apparatus to be used. Therefore, complication in the structure of an image forming apparatus can be also prevented.

Now, the fluororesin particles, the shell layer, and the core included in the toner particle will be described. In addition, an external additive optionally included in the toner particle will be described. A method for producing the toner will be also described.

<Fluororesin Particles>

A fluororesin is a resin having a fluoro group. Examples of the fluororesin contained in the fluororesin particles include polytetrafluoroethylene (hereinafter sometimes referred to as PTFE), a tetrafluoroethylene-perfluoroalkylvinylether copolymer (hereinafter sometimes referred to as PFA), polychlorotrifluoroethylene, polyvinylidene fluoride, polyvinyl fluoride, a perfluoroalkoxy fluororesin, an ethylene tetrafluoride-propylene hexafluoride copolymer, an ethylene-ethylene tetrafluoride copolymer, and an ethylene-chlorotrifluoroethylene copolymer. The fluororesin particles preferably contain PFA or PTFE, and more preferably contain PFA. Incidentally, PFA is a copolymer of a repeating unit represented by formula (1) and a repeating unit represented by formula (2). PTFE is a polymer of the repeating unit represented by formula (1). In formula (2), Rf represents a perfluoroalkyl group. Rf in formula (2) is preferably a perfluoroalkyl group having a carbon number of at least 1 and no greater than 6, and is more preferably a trifluoromethyl group.

(1)

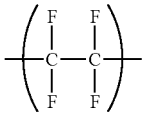

(2)

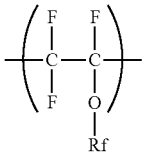

The number average primary particle diameter of the fluororesin particles is preferably 0.01 μm or more and 0.50 μm or less. The number average primary particle diameter of the fluororesin particles is more preferably 0.01 μm or more and 0.05 μm or less, and further preferably 0.01 μm or more and 0.03 μm or less. The number average primary particle diameter of the fluororesin particles may be 0.20 μm or more and 0.40 μm or less.

When the fluororesin particles contain PFA, the melting point of the PFA is preferably 250° C. or more and 350° C. or less, and more preferably 290° C. or more and 310° C. or less. The melting point of PFA can be measured by a method according to ASTM D 4591.

When the fluororesin particles contain PTFE, the melting point of the PTFE is preferably 250° C. or more and 350° C. or less, and more preferably 320° C. or more and 340° C. or less. The melting point of PTFE can be measured by a method according to JIS K6891.

A content of the fluororesin particles is preferably 0.1% by mass or more and 10.0% by mass or less with respect to the mass of the core. The content of the fluororesin particles may be 0.1% by mass or more and 1.0% by mass or less, more than 1.0% by mass and 5.0% by mass or less, or more than 5.0% by mass and 10.0% by mass or less with respect to the mass of the core.

When the fluororesin particles are positioned within the core, the content of the fluororesin particles is preferably more than 0.0 parts by mass and 10.0 parts by mass or less, and more preferably 1.0 part by mass or more and 10.0 parts by mass or less with respect to 100.0 parts by mass of a binder resin. When the fluororesin particles are positioned within the core, the content of the fluororesin particles may be 1.0 part by mass or more and 3.0 parts by mass or less, more than 3.0 parts by mass and 7.0 parts by mass or less, or more than 7.0 parts by mass and 10.0 parts by mass or less with respect to 100.0 parts by mass of the binder resin.

When the fluororesin particles are positioned between the core and the shell layer, the content of the fluororesin particles is preferably more than 0.0 part by mass and 10.0 parts by mass or less, more preferably 0.1 parts by mass or more and 10.0 parts by mass or less, further preferably 0.1 parts by mass or more and 1.5 parts by mass or less, and still further preferably 0.1 parts by mass or more and 1.0 part by mass or less with respect to 100.0 parts by mass of the core. In the toner particle in which the fluororesin particles are positioned between the core and the shell layer, the fluororesin particles are positioned closer to the surface of the toner particle as compared with the toner particle in which the fluororesin particles are positioned within the core. Therefore, when the fluororesin particles are positioned between the core and the shell layer, a probability that the fluororesin particles come into contact with the heating section of the fixing device is increased, and hence, the toner including the fluororesin particles disposed on a recording medium can be particularly inhibited from moving onto the heating section of the fixing device through electrostatic attraction to the heating section. Therefore, through the toner particle in which the fluororesin particles are positioned between the core and the shell layer, occurrence of electrostatic offset can be inhibited as compared with the toner particle in which the fluororesin particles are positioned within the core even if merely a small amount of the fluororesin particles is contained. Since the content of the fluororesin particles can be thus reduced, the production cost for the toner particles in which the fluororesin particles are positioned between the core and the shell layer can be reduced.

Since the fluororesin particles are negatively chargeable, in order to retain the good positive chargeability of the toner, it is preferable that the fluororesin particles are not externally added to the toner particle. For the same reason, it is preferable that the fluororesin particles are not positioned on the outermost surface of the toner particle. For the same reason, it is preferable that the fluororesin particles are not provided on the surface of the shell layer. For the same reason, it is preferable that the fluororesin particles are not positioned within the shell layer. For the same reason, it is preferable that the fluororesin particles are positioned merely within the core, or merely between the core and the shell layer.

The position of each fluororesin particle in the toner particle can be found by, for example, the following method: A TEM photograph is obtained by imaging the cross-section of the toner particle with a field-emission transmission electron microscope (TEM, "JEM-2100F" manufactured by JEOL Ltd.). The TEM photograph is analyzed with image analysis software ("WinROOF" manufactured by Mitani Corporation) to find the position of the fluororesin particle in the toner particle.

Preferably, the fluororesin particles are positioned between the core and the shell layer, and the content of the fluororesin particles is 0.1% by mass or more and 1.0% by mass or less with respect to the mass of the core. With such toner particles, occurrence of electrostatic offset can be inhibited while the production cost can be reduced.

More preferably, the fluororesin particles are positioned between the core and the shell layer, the content of the fluororesin particles is 0.1% by mass or more and 1.0% by mass or less with respect to the mass of the core, and the number average primary particle diameter of the fluororesin particles is 0.01 μm or more and 0.05 μm or less. With such toner particles the production cost can be reduced and occurrence of electrostatic offset can be inhibited. In addition, the core having the fluororesin particles on the surface thereof can be suitably covered with the shell layer.

<Shell Layer>

The shell layers contain the positively chargeable material. The positively chargeable material is a material that positively charges the shell layers (and eventually the toner particles) through friction between, for example, a carrier and the shell layer. The shell layer may wholly cover the surface of the core or may partially cover the surface of the core. In order to retain the good positive chargeability of the toner, the shell layer preferably wholly covers the surface of the core.

The shell layer may be constituted substantially of a thermosetting resin. Alternatively, the shell layer may be constituted substantially of a thermoplastic resin. Alternatively, the shell layer may contain both a thermosetting resin and a thermoplastic resin. Besides, a resin containing an additive (such as a positive charge control agent) may be used as a constituent material of the shell layer.

Examples of the positively chargeable material contained in the shell layers include a thermosetting nitrogen-containing resin, a thermoplastic resin having a quaternary ammonium cationic group, and a positive charge control agent. In order to easily form the shell layer with the good positive chargeability of the toner particle retained, suitable examples of the positively chargeable material include a thermosetting nitrogen-containing resin, and a thermoplastic resin having a quaternary ammonium cationic group. When the shell layers contain, as the positively chargeable material, a thermosetting nitrogen-containing resin or a thermoplastic resin having a quaternary ammonium cationic group, it is preferable that the shell layers do not contain a positive charge control agent.

The thermosetting nitrogen-containing resin is a resin, among thermosetting resins, having a nitrogen atom in the chemical structure thereof. Examples of the thermosetting nitrogen-containing resin include a melamine resin, a urea resin, a sulfonamide resin, a glyoxal resin, a benzoguanamine resin, an aniline resin, a polyimide resin, and derivatives of these resins. In order to retain the good positive chargeability of the toner particles, the thermosetting nitrogen-containing resin is preferably a melamine resin or a urea resin, and more preferably a urea resin.

An example of the thermoplastic resin having a quaternary ammonium cationic group includes a polymer of a vinyl compound having a quaternary ammonium cationic group. Another example of the thermoplastic resin having a quaternary ammonium cationic group includes a copolymer of a vinyl compound having a quaternary ammonium cationic group and a different vinyl compound. It is noted that the different vinyl compound is a vinyl compound different from the vinyl compound having a quaternary ammonium cationic group. A vinyl compound contains, in a molecule thereof, a vinyl group ($CH_2$═CH—) or a substituted vinyl group in which a hydrogen atom is replaced. When a carbon double bond (C═C) contained in a functional group such as a vinyl group is cleaved and addition polymerization is caused, a vinyl compound is changed into a polymer (a vinyl resin).

Examples of the vinyl compound having a quaternary ammonium cationic group include vinylbenzyltrialkylammonium salt, 2-(acryloyloxy)ethyl trialkylammonium salt, and 2-(methacryloyloxy)ethyl trialkylammonium salt.

Examples of the vinylbenzyltrialkylammonium salt include vinylbenzyltrimethylammonium salt (more specifically, vinylbenzyltrimethylammonium chloride or the like), vinylbenzyltriethylammonium salt (more specifically, vinylbenzyltriethylammonium chloride or the like), vinylbenzyldimethylethylammonium salt (more specifically, vinylbenzyldimethylethylammonium chloride or the like), vinylbenzyldimethylisopropylammonium salt (more specifically, vinylbenzyldimethylisopropylammonium chloride or the like), vinylbenzyl n-butyldimethylammonium salt (more specifically, vinylbenzyl n-butyldimethylammonium chloride or the like), and vinylbenzyldimethylpentylammonium salt (more specifically, vinylbenzyldimethylpentylammonium chloride or the like).

Examples of the 2-(acryloyloxy)ethyl trialkylammonium salt include 2-(acryloyloxy)ethyl trimethylammonium salt (more specifically, 2-(acryloyloxy)ethyl trimethylammonium chloride or the like), 2-(acryloyloxy)ethyl dimethylethylammonium salt (more specifically, 2-(acryloyloxy)ethyl dimethylethylammonium chloride or the like), 2-(acryloyloxy)ethyl triethylammonium salt (more specifically, 2-(acryloyloxy)ethyl triethylammonium chloride or the like), and 2-(acryloyloxy)ethyl dimethyl n-pentylammonium salt (more specifically, 2-(acryloyloxy)ethyl dimethyl n-pentylammonium chloride).

Examples of the 2-(methacryloyloxy)ethyl trialkylammonium salt include 2-(methacryloyloxy)ethyl trimethylammonium salt (more specifically, 2-(methacryloyloxy)ethyl trimethylammonium chloride or the like), 2-(methacryloyloxy)ethyl dimethylethylammonium salt (more specifically, 2-(methacryloyloxy)ethyl dimethylethylammonium chloride or the like), and 2-(methacryloyloxy)ethyl dimethyl n-pentylammonium salt (more specifically, 2-(methacryloyloxy)ethyl dimethyl n-pentylammonium chloride or the like).

The vinyl compound having a quaternary ammonium cationic group is preferably 2-(methacryloyloxy)ethyl trialkylammonium salt, more preferably 2-(methacryloyloxy)ethyl trimethylammonium salt, and further preferably 2-(methacryloyloxy)ethyl trimethylammonium chloride.

Examples of the different vinyl compound copolymerizable with the vinyl compound having a quaternary ammonium cationic group include styrene-based compounds (more specifically, o-methylstyrene, m-methylstyrene, p-methylstyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, p-n-dodecylstyrene and the like); (meth)acrylates (more specifically, methyl (meth)acrylate, ethyl (meth)acrylate, propyl (meth) acrylate, butyl (meth)acrylate, pentyl (meth)acrylate, hexyl (meth)acrylate, heptyl (meth)acrylate, octyl (meth)acrylate, stearyl (meth)acrylate, lauryl (meth)acrylate, phenyl (meth) acrylate and the like); (meth)acrylic acids; (meth)acrylonitrile; ethylene; propylene; butadiene; and vinyl chloride. The vinyl compound having a quaternary ammonium cationic group may be copolymerized with one of these different vinyl compounds, or may be copolymerized with two or more of these different vinyl compounds.

The different vinyl compound copolymerizable with the vinyl compound having a quaternary ammonium cationic group is preferably (meth)acrylate, more preferably alkyl (meth)acrylate, further preferably methyl (meth)acrylate and butyl (meth)acrylate, and particularly preferably methyl methacrylate and butyl acrylate.

The thermoplastic resin having a quaternary ammonium cationic group is preferably a copolymer of a vinyl compound having a quaternary ammonium cationic group and a different vinyl compound, more preferably a copolymer of 2-(methacryloyloxy)ethyl trialkylammonium salt and two or more alkyl (meth)acrylates, further preferably a copolymer of 2-(methacryloyloxy)ethyl trimethylammonium salt, methyl (meth)acrylate and butyl (meth)acrylate, and particularly preferably a copolymer of 2-(methacryloyloxy)ethyl trimethylammonium chloride, methyl methacrylate and butyl acrylate.

When the positively chargeable material contained in the shell layers is a positive charge control agent, examples of a usable positive charge control agent include azine compounds (more specifically, pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, quinoxaline and the like); direct dyes (more specifically, azine fast red FC, azine fast red 12BK, azine violet BO, azine brown 3G, azine light brown GR, azine dark green BH/C, azine deep black EW, azine deep black 3RL and the like); acid dyes (more specifically, nigrosin BK, nigrosin NB, nigrosin Z and the like); metal salts of naphthenic acid; metal salts of higher organic carboxylic acid; alkoxylated amine; alkylamide; and quaternary ammonium salts (more specifically, benzyldecylhexylmethylammonium chloride, decyltrimethylammonium chloride, 2-(methacryloyloxy)ethyl trimethylammonium chloride, dimethylaminopropyl acrylamide methyl chloride quaternary salt and the like).

The shell layers may contain the positively chargeable material alone. Alternatively, the shell layers may contain a mixed material of the positively chargeable material and an additional material. An example of the additional material includes a styrene-acrylic resin. Specific examples of the styrene-acrylic resin are the same as specific examples of a styrene-acrylic resin described later as a binder resin. As an example of the additional material, a styrene-butyl acrylate copolymer is preferred. When the shell layers contain the mixed material of the positively chargeable material and the additional material, a content of the positively chargeable material in the mixed material is preferably 70% by mass or more, more preferably 90% by mass or more, and further preferably 95% by mass or more for retaining the good positive chargeability of the toner particles.

The shell layers have a thickness of, preferably 1 nm or more and 40 nm or less, and more preferably 5 nm or more and 50 nm or less for obtaining a toner suitable for image formation.

<Cores>

The cores contain, for example, a binder resin. The cores may further contain, if necessary, at least one of a colorant, a release agent, a magnetic powder, and a charge control agent.

(Binder Resin)

The cores contain the binder resin. In order to obtain a toner having excellent low-temperature fixability, the cores preferably contain, as the binder resin, a thermoplastic resin, and more preferably contain a thermoplastic resin in a ratio of 85% by mass or more in the whole binder resin. Examples of the thermoplastic resin include polyester resins, styrene-based resins, acrylate-based resins (more specifically, an acrylate polymer, a methacrylate polymer and the like), olefin-based resins (more specifically, a polyethylene resin, a polypropylene resin and the like), vinyl resins (more specifically, a vinyl chloride resin, polyvinyl alcohol, a vinyl ether resin, a N-vinyl resin and the like), polyamide resins, and urethane resins. Besides, a copolymer of these resins, namely, a copolymer obtained by introducing an arbitrary repeating unit into any one of these resins, (more specifically, a styrene-acrylic resin, a styrene-butadiene-based resin or the like) can be used as the binder resin. The cores may contain merely one binder resin, or may contain two or more binder resins.

In order to further inhibit occurrence of electrostatic offset, the binder resin is preferably a polyester resin or a styrene-acrylic resin.

A polyester resin is obtained by condensation polymerization of one or more polyhydric alcohol monomers and one or more polycarboxylic acid monomers. A polyester resin is a polymer of one or more polyhydric alcohol monomers and one or more polycarboxylic acid monomers. Incidentally, a polycarboxylic acid derivative (more specifically, an anhydride of polycarboxylic acid, a polycarboxylic acid halide or the like) may be used instead of a polycarboxylic acid monomer.

Examples of the polyhydric alcohol monomer include a diol monomer, a bisphenol monomer, and a trivalent or higher valent alcohol monomer.

Examples of the diol monomer include ethylene glycol, diethylene glycol, triethylene glycol, 1,2-propanediol, 1,3-propanediol, 1,4-butanediol, neopentyl glycol, 2-butene-1,4-diol, 1,5-pentanediol, 1,6-hexanediol, 1,4-cyclohexanedimethanol, 1,4-benzenediol, dipropylene glycol, polyethylene glycol, polypropylene glycol, and polytetramethylene glycol.

Examples of the bisphenol monomer include bisphenol A, hydrogenated bisphenol A, a bisphenol A ethylene oxide adduct, and a bisphenol A propylene oxide adduct.

Examples of the trivalent or higher valent alcohol monomer include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of the polycarboxylic acid monomer include a divalent carboxylic acid monomer and a trivalent or higher valent carboxylic acid monomer.

Examples of the divalent carboxylic acid monomer include maleic acid, fumaric acid, citraconic acid, itaconic acid, glutaconic acid, phthalic acid, isophthalic acid, terephthalic acid, 5-sulfoisophthalic acid, sodium 5-sulfoisophthalate, cyclohexane dicarboxylic acid, adipic acid, sebacic acid, azelaic acid, malonic acid, succinic acid, alkyl succinic acid, and alkenyl succinic acid. Examples of the alkyl succinic acid include n-butyl succinic acid, isobutyl succinic acid, n-octyl succinic acid, n-dodecyl succinic acid, and isododecyl succinic acid. Examples of the alkenyl succinic acid include n-butenyl succinic acid, isobutenyl succinic acid, n-octenyl succinic acid, n-dodecenyl succinic acid, and isododecenyl succinic acid.

Examples of the trivalent or higher valent carboxylic acid monomer include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra(methylenecarboxyl) methane, 1,2,7,8-octanetetracarboxylic acid, pyromellitic acid, and Empol trimer acid.

A styrene-acrylic resin is a copolymer of one or more styrene-based monomers and one or more alkyl (meth) acrylate monomers.

A styrene-based monomer is styrene or a derivative thereof. Suitable examples of the styrene-based monomer include styrene, α-methylstyrene, p-hydroxy styrene, m-hydroxy styrene, vinyl toluene, and p-ethylstyrene. The styrene-based monomer is preferably styrene.

Suitable examples of the alkyl (meth)acrylate monomer include methyl (meth)acrylate, ethyl (meth)acrylate, propyl (meth)acrylate, butyl (meth)acrylate, pentyl (meth)acrylate, hexyl (meth)acrylate, and octyl (meth)acrylate. The alkyl (meth)acrylate monomer is preferably butyl (meth)acrylate.

In order to further inhibit occurrence of electrostatic offset, the styrene-acrylic resin is preferably a styrene-butyl acrylate copolymer.

(Colorant)

The cores may contain a colorant. As the colorant, any of known pigments or dyes can be used in accordance with the color of the toner. In order to form a high quality image with the toner, the amount of the colorant is preferably 1 part by mass or more and 20 parts by mass or less with respect to 100 parts by mass of the binder resin. The cores may contain merely one colorant, or may contain two or more colorants.

The cores may contain a black colorant. An example of the black colorant includes carbon black. Alternatively, the black colorant may be a colorant whose color is adjusted to black using a yellow colorant, a magenta colorant, and a cyan colorant.

The cores may contain a color colorant. Examples of the color colorant include a yellow colorant, a magenta colorant, and a cyan colorant.

As the yellow colorant, one or more compounds selected from the group consisting of, for example, condensed azo compounds, isoindolinone compounds, anthraquinone compounds, azo metal complexes, methine compounds, and arylamide compounds can be used. Examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Bat Yellow.

As the magenta colorant, one or more compounds selected from the group consisting of, for example, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used. Examples of the magenta colorant include C.I. Pigment Red (2, 3, 5, 6, 7, 19, 23, 48:2, 48:3, 48:4, 57:1 81:1, 122, 144, 146, 150, 166, 169, 177, 184, 185, 202, 206, 220, 221, or 254).

As the cyan colorant, one or more compounds selected from the group consisting of, for example, copper phthalocyanine compounds, anthraquinone compounds, and basic dye lake compounds can be used. Examples of the cyan colorant include C.I. Pigment Blue (1, 7, 15, 15:1, 15:2, 15:3, 15:4, 60, 62, or 66), phthalocyanine blue, C.I. Bat Blue, and C.I. Acid Blue.

(Release Agent)

The cores may contain a release agent. The release agent is used for purpose of, for example, obtaining a toner excellent in hot offset resistance. In order to obtain a toner excellent in hot offset resistance, the amount of the release agent is preferably 1 part by mass or more and 20 parts by mass or less with respect to 100 parts by mass of the binder resin.

Examples of the release agent include an aliphatic hydrocarbon-based wax, an oxide of an aliphatic hydrocarbon-based wax, a plant derived wax, an animal derived wax, a mineral derived wax, an ester wax containing a fatty acid ester as a principal component, and a wax obtained by deoxidizing part or whole of a fatty acid ester. Examples of the aliphatic hydrocarbon-based wax include a polyethylene wax (such as low molecular weight polyethylene), a propylene wax (such as low molecular weight polypropylene), a polyolefin copolymer, a polyolefin wax, a microcrystalline wax, a paraffin wax, and a Fischer-Tropsch wax. Examples of the oxide of an aliphatic hydrocarbon-based wax includes a polyethylene oxide wax, and a block copolymer of a polyethylene oxide wax. Examples of the plant derived wax include candelilla wax, carnauba wax, haze wax, jojoba wax, and rice wax. Examples of the animal derived wax include beeswax, lanolin, and spermaceti wax. Examples of the mineral derived wax include ozokerite, ceresin, and petrolatum. Examples of the ester wax containing a fatty acid ester as a principal component include montanic acid ester wax, and castor wax. An example of the wax obtained by deoxidizing part or whole of a fatty acid ester includes deoxidized carnauba wax. The cores may contain merely one release agent, or may contain two or more release agents.

(Charge Control Agent)

The cores may contain a charge control agent. The charge control agent is used for purpose of, for example, obtaining a toner excellent in charge stability and charge rising property. The charge rising property of a toner can be an index whether or not the toner can be charged to a prescribed charge level in a short period of time. The charge control agent is preferably a positive charge control agent. The positive charge control agent is a positively chargeable charge control agent. When a positive charge control agent (more specifically, pyridine, nigrosin, quaternary ammonium salt or the like) is contained in the cores, the cationic property (positive chargeability) of the toner can be enhanced. The cores may contain merely one positive charge control agent, or may contain two or more positive charge control agents. When sufficient positive chargeability can be obtained in the toner, however, there is no need to cause the cores to contain a positive charge control agent. The toner of the first embodiment contains the positively chargeable material in the shell layers, and therefore, there is no need not only for the core but also for the toner particles to contain a charge control agent (a positive charge control agent in particular).

(Magnetic Powder)

The cores may contain a magnetic powder. Examples of a material of the magnetic powder include ferromagnetic metals (more specifically, iron, cobalt, nickel and the like) and alloys thereof, ferromagnetic metal oxides (more specifically, ferrite, magnetite, chromium dioxide and the like), and a material having been subjected to a ferromagnetization treatment (more specifically, a heat treatment or the like). The cores may contain merely one magnetic powder, or may contain two or more magnetic powders.

<External Additive>

In order to obtain a toner excellent in flowability and handleability, an amount of an external additive is preferably 0.1 parts by mass or more and 10 parts by mass or less with respect to 100 parts by mass of the toner mother particles. External additive particles are preferably inorganic particles, and more preferably silica particles, or particles of a metal oxide (more specifically, aluminum oxide, titanium oxide, magnesium oxide, zinc oxide, strontium titanate, barium titanate or the like). The toner particles may include particles of merely one external additive or may contain particles of two or more external additives.

The external additive particles may be subjected to a surface treatment. For example, when silica particles are used as the external additive particles, hydrophobicity and/or positive chargeability may be imparted to the surfaces of the silica particles by a surface treatment agent. Examples of the surface treatment agent include coupling agents (more specifically, a silane coupling agent, a titanate coupling agent, an aluminate coupling agent and the like), silazane compounds (more specifically, a chain silazane compound, a cyclic silazane compound and the like), and silicone oils (more specifically, dimethyl silicone oil and the like). The surface treatment agent is preferably a silane coupling agent (more specifically, trimethylmethoxysilane, aminosilane or the like) or a silazane compound.

(Combination of Materials)

In order to further inhibit occurrence of electrostatic offset and further retain the good positive chargeability, a combination of the binder resin of the cores, the constituent material and the position of the fluororesin particles, and the constituent material of the shell layers is preferably any one of combination examples Z1 to Z7 shown in Table 1 below and combination examples X1 to X9 shown in Table 2 below. It is noted that terms used in Tables 1 and 2 are defined the same as terms used in Tables 3 and 4 described later.

TABLE 1

| Combination | Core Binder | Fluororesin Particle | | Shell |
|---|---|---|---|---|
| Example | Resin | Material | Position | Material |
| Z1 | PES | PTFE | within core | UF |
| Z2 | SA | PTFE | within core | UF |
| Z3 | PES | PFA | within core | UF |

TABLE 1-continued

| Combination Example | Core Binder Resin | Fluororesin Particle Material | Fluororesin Particle Position | Shell Material |
|---|---|---|---|---|
| Z4 | PES | PTFE | between core and shell | UF |
| Z5 | PES | PTFE | within core | QA |
| Z6 | PES | PTFE | within core | QA/SA (95/5) |
| Z7 | PES | PTFE | within core | QA/SA (70/30) |

TABLE 2

| Combination Example | Core Binder Resin | Fluororesin Particle Material | Fluororesin Particle Particle diameter [μm] | Fluororesin Particle Position | Shell Material |
|---|---|---|---|---|---|
| X1 | PES | PTFE | 0.25 or more and 0.35 or less | within core | UF |
| X2 | SA | PTFE | 0.25 or more and 0.35 or less | within core | UF |
| X3 | PES | PTFE | 0.15 or more and less than 0.25 | within core | UF |
| X4 | PES | PTFE | more than 0.35 and 0.45 or less | within core | UF |
| X5 | PES | PFA | more than 0.35 and 0.45 or less | within core | UF |
| X6 | PES | PTFE | 0.01 or more and 0.05 or less | between core and shell | UF |
| X7 | PES | PTFE | 0.25 or more and 0.35 or less | within core | QA |
| X8 | PES | PTFE | 0.25 or more and 0.35 or less | within core | QA/SA (95/5) |
| X9 | PES | PTFE | 0.25 or more and 0.35 or less | within core | QA/SA (70/30) |

<Production Method for Toner>

Next, a preferable production method for the toner of the first embodiment will be described. The production method for the toner includes a core preparation step, and a shell layer formation step. Besides, the production method for the toner may further include, after the shell layer formation step, an external addition step.

(Core Preparation Step)

In the core preparation step, cores are prepared by, for example, a pulverization method or an agglomeration method. The core preparation step will now be described on the assumption that the pulverization method is employed.

For production of toner particles including fluororesin particles positioned within cores, a binder resin, the fluororesin particles, and another internal additive added if necessary are mixed. Another internal additive is, for example, at least one of a colorant, a release agent, a magnetic powder, and a charge control agent. The thus obtained mixture is melt kneaded using a melt kneader (such as a single-screw or twin-screw extruder). The resultant melt kneaded product is pulverized and classified. In this manner, cores including the fluororesin particles positioned therein are obtained.

For production of toner particles containing fluororesin particles positioned between cores and shell layers, a binder resin and another internal additive added if necessary are mixed. The thus obtained mixture is melt kneaded using a melt kneader (such as a single-screw or twin-screw extruder). The resultant melt kneaded product is pulverized and classified. The thus obtained classified product and fluororesin particles are mixed by stirring using a mixer. Thus, the fluororesin particles adhere to the surface of the classified product. As a result, cores including the fluororesin particles positioned on the surface thereof are obtained. When the cores including the fluororesin particles positioned on the surface thereof are subjected to the shell layer formation step described below, toner particles containing the fluororesin particles positioned between the cores and shell layers are obtained.

(Shell Layer Formation Step)

In the shell layer formation step, shell layers are formed on the surfaces of the cores. Examples of a method for forming the shell layers include an in-situ polymerization method, an in-liquid curing coating method, and a coacervation method. A suitable specific example includes the following method.

First, a material for forming shell layers (hereinafter sometimes referred to as the shell material) and the cores obtained through the core preparation step are put in an aqueous medium. An example of the shell material includes a monomer forming a positively chargeable material. When the aqueous medium containing the monomer forming a positively chargeable material and the cores are heated, a polymerization reaction of the monomer forming a positively chargeable material proceeds to form shell layers on the surfaces of the cores. Another example of the shell material includes positively chargeable resin particles. When the aqueous medium containing the positively chargeable resin particles and the cores are heated, film formation of the resin particles proceeds with the resin particles caused to adhere to the surfaces of the cores, and thus, the shell layers are formed on the surfaces of the cores.

(External Addition Step)

In the external addition step, an external additive is caused to adhere to the surfaces of the toner mother particles. Each of the toner mother particles is a particle obtained through the shell layer formation step (specifically, the particle including the core and the shell layer formed on the surface of the core). An example of a method for causing the external additive to adhere to the surfaces of the toner mother particles includes a method in which the toner mother particles and the external additive particles are mixed by stirring, for example, using a mixer to cause the external additive particles to adhere to the surfaces of the toner mother particles. Through the production method described so far, the toner of the first embodiment is obtained.

Second Embodiment: Image Forming Apparatus

Figure 3:
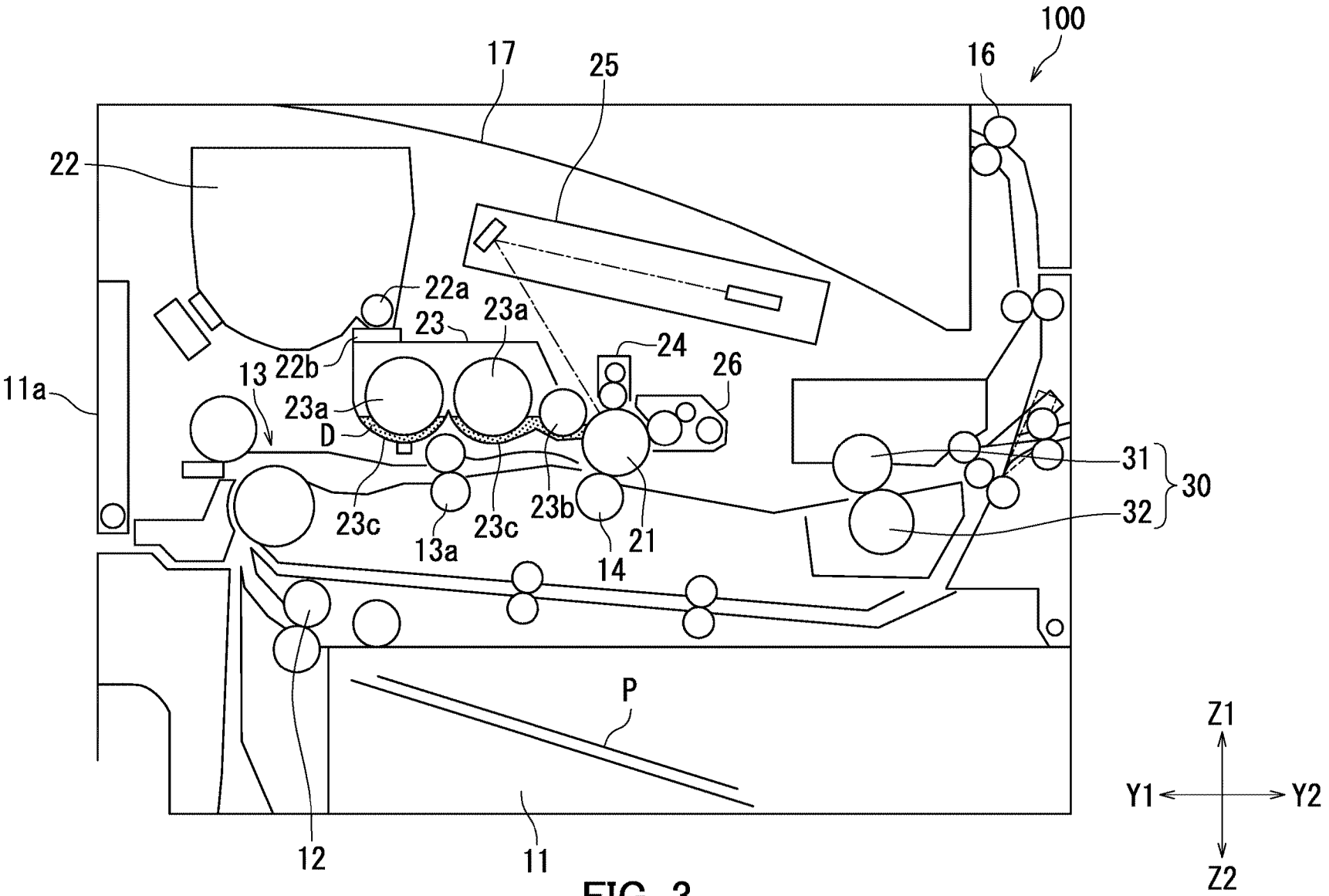
FIG. 3 is a diagram illustrating an example of a structure of an image forming apparatus according to a second embodiment of the present disclosure.

Next, referring to FIG. 3, an image forming apparatus 100 according to a second embodiment of the present disclosure will be described. The image forming apparatus 100 of the second embodiment holds a developer D containing the toner of the first embodiment. It is noted that arrows Y1, Y2, Z1 and Z2 illustrated in FIG. 3 and FIG. 4 described below correspond to four directions according with mutually perpendicular two axes (Y-axis and Z-axis). The arrow Z1 corresponds to the upward direction of the image forming apparatus 100, the arrow Z2 corresponds to the downward direction of the image forming apparatus 100, the arrow Y1 corresponds to the forward direction of the image forming apparatus 100, and the arrow Y2 corresponds to the backward direction of the image forming apparatus 100.

The image forming apparatus 100 includes an image bearing member 21, a developing device 23, a transfer device 14, and a fixing device 30. The developing device 23 holds the developer D. The developer D contains the toner of the first embodiment. The developing device 23 develops, with the developer D, an electrostatic latent image formed on the image bearing member 21 into a toner image T. The transfer device 14 transfers the toner image T formed on the image bearing member 21 onto a recording medium P. The fixing device 30 fixes, on the recording medium P, the toner image T having been transferred onto the recording medium P. Since the image forming apparatus 100 uses the developer D containing the toner of the first embodiment, occurrence of electrostatic offset can be inhibited as well as the good positive chargeability can be attained for the same reason as that described in the first embodiment.

The image forming apparatus 100 further includes, in addition to the image bearing member 21, the developing device 23, the transfer device 14, and the fixing device 30, a paper feed cassette 11, a manual feed tray 11*a*, a paper feed roller 12, a conveyance path 13, a conveyance roller 13*a*, an exit roller 16, an exit section 17, a toner container 22, a charging unit 24, an exposing unit 25, and a cleaner 26.

The paper feed cassette 11 holds a large number of recording media P (such as printing paper). The paper feed roller 12 feeds the recording media P held in the paper feed cassette 11 one by one to the conveyance path 13. The conveyance roller 13*a* is provided in the conveyance path 13. The conveyance roller 13*a* conveys each recording medium P having been fed to the conveyance path 13 toward the transfer device 14. It is noted that a recording medium P set in the manual feed tray 11*a* is also conveyed to the transfer device 14 in the same manner as the recording medium P held in the paper feed cassette 11.

The image bearing member 21 is a photosensitive drum. The image bearing member 21 is rotatably supported in a housing of the image forming apparatus 100. The image bearing member 21 is driven to rotate by, for example, a motor (not shown).

In the image forming apparatus 100, one developing device 23 is provided correspondingly to one image bearing member 21. Besides, one toner container 22 is provided correspondingly to one developing device 23.

The toner container 22 holds the toner of the first embodiment. The toner container 22 includes a supply roller 22*a*, and a toner supply path 22*b*. When the supply roller 22*a* rotates, the toner held in the toner container 22 is supplied through the toner supply path 22*b* of the toner container 22 to the developing device 23. The supply roller 22*a* is driven to rotate by, for example, a motor (not shown).

The developing device 23 includes a plurality of (for example, two) stirring screws 23*a*, a development roller 23*b*, and a plurality of (for example, two) developer containers 23*c*. The development roller 23*b* includes a metal shaft, a magnet roll, and a development sleeve made of a non-magnetic material. The magnetic roll has, at least on surface portions thereof, magnetic pole portions (such as N pole and S pole based on a permanent magnet), and is fixed on the shaft. The development sleeve is rotatably provided on the surface portion of the magnet roll. Specifically, the shaft and the development sleeve are connected to each other through a flange so that the development sleeve can rotate around the non-rotating magnet roll.

The developer D is held in each developer container 23*c* of the developing device 23. The developer D is a two-component developer containing the toner of the first embodiment and a carrier (specifically, a magnetic carrier). The toner is supplied from the toner container 22 to the developer container 23*c* of the development unit 23 as needed. When the stirring screw 23*a* rotates, the developer D held in the developer container 23*c* of the developing device 23 is stirred. When the developer D containing the toner is stirred, the toner is positively charged through friction with the carrier. The development roller 23*b* supplies the toner (for example, the toner supplied from the toner container 22) held in the developer container 23*c* to the image bearing member 21. Each of the stirring screws 23*a* and the development roller 23*b* is driven to rotate by, for example, a motor (not shown). It is noted that the developer D held in the development container 23*c* is not limited to the two-component developer but may be a one-component developer.

The charging unit 24 includes, for example, a charging member (more specifically, a charging roller or the like) disposed in contact with the surface of the image bearing member 21. The charging unit 24 uniformly charges a surface portion (for example, a photosensitive layer) of the image bearing member 21 with static electricity. Thus, the charging unit 24 charges the surface portion (for example, the photosensitive layer) of the image bearing member 21.

The exposing unit 25 includes, for example, an LED (light emitting diode) head as a light source. The exposing unit 25 exposes the surface portion (for example, the photosensitive layer) of the image bearing member 21 to form an electrostatic latent image on the surface of the image bearing member 21.

For forming an image on the recording medium P by the image forming apparatus 100, the charging unit 24 charges the photosensitive layer of the image bearing member 21. Subsequently, the exposing unit 25 selectively irradiates the photosensitive layer of the image bearing member 21 with light. A light irradiation position is determined in accordance with image data. A portion of the photosensitive layer irradiated with light has potential lowered. As a result, an electrostatic latent image is formed on the surface of the image bearing member 21.

Subsequently, the developing device 23 supplies the toner (for example, the toner charged through the friction with the carrier) contained in the developer D to the electrostatic latent image formed on the image bearing member 21, and thus, the electrostatic latent image is developed into a toner image T. Specifically, the charged toner selectively adheres to the electrostatic latent image formed on the photosensitive layer. As a result, the toner image T is formed on the surface of the image bearing member 21.

The recording medium P is conveyed by the conveyance roller 13*a* to pass between the image bearing member 21 and the transfer device 14. At this point, when a bias (voltage) is applied to the transfer device 14, the toner image T having been formed on the image bearing member 21 is transferred onto the recording medium P.

The fixing device 30 fixes the toner image T on the recording medium P by performing at least one of heating and pressing. In this manner, an image is formed on the recording medium P. The recording medium P thus having the image formed thereon is discharged to the exit section 17 by the exit roller 16.

After the toner image T is transferred from the image bearing member 21 to the recording medium P, the toner remaining on the surface of the image bearing member 21 is removed by the cleaner 26. Besides, the image forming apparatus 100 may include a static elimination device (not shown) for eliminating residual charge on the surface of the image bearing member 21.

Figure 4:
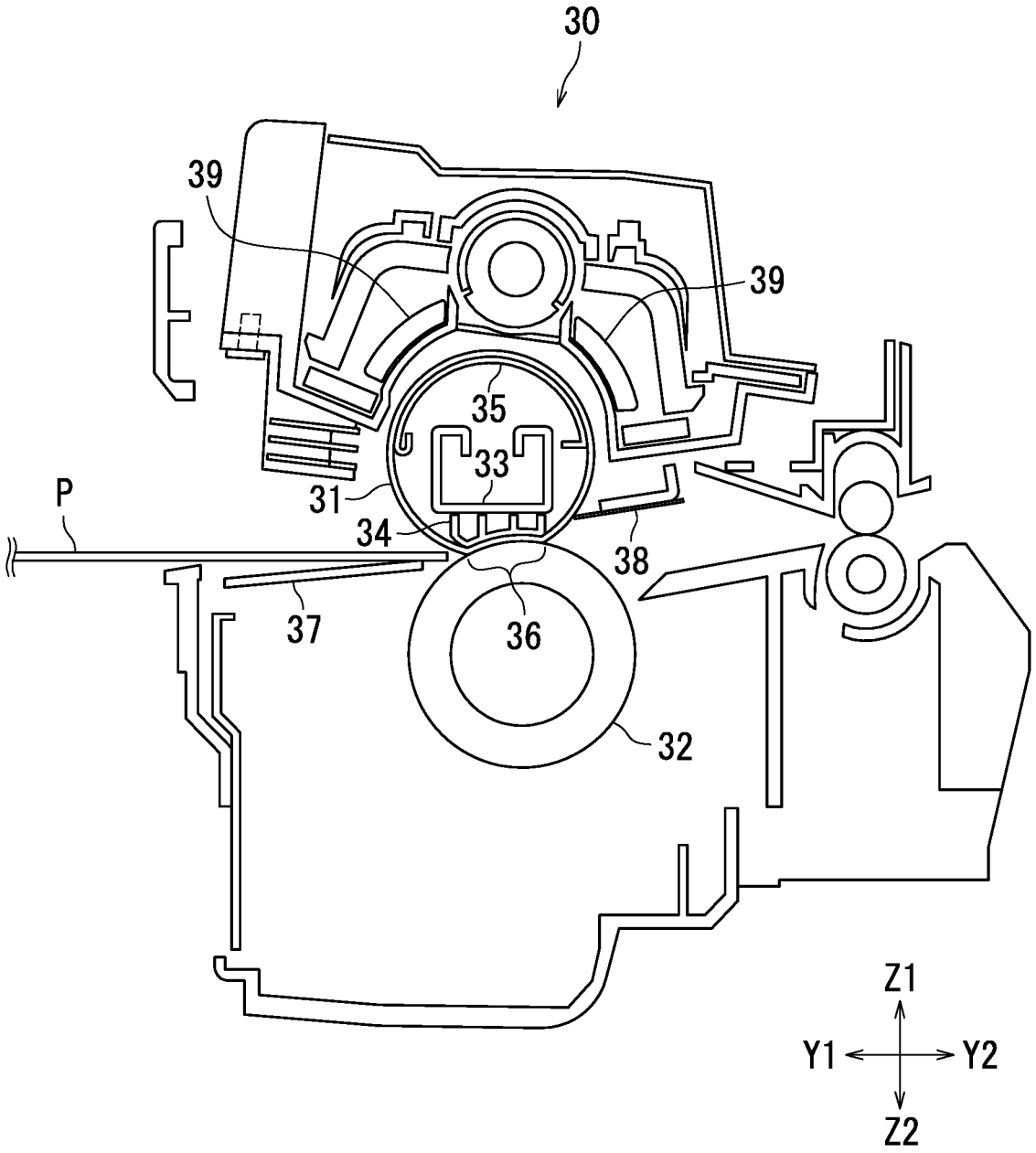
FIG. 4 is a diagram of a fixing device illustrated in FIG. 3.

Next, referring to FIG. 4, the fixing device 30 will be described in more detail. FIG. 4 illustrates the fixing device 30 of FIG. 3.

As illustrated in FIG. 4, the fixing device 30 includes a fixing belt 31 corresponding to a heating section, a pressure roller 32, a holding member 33, a nip forming member 34, a guide plate 35, a conveyance guide 37, a separation plate 38, and a plurality of (for example, two) induction coils 39. The fixing device 30 may include, as the heating section, a fixing roller instead of the fixing belt 31.

The fixing belt 31 is provided in a substantially cylindrical shape having a larger dimension in a width direction vertical to a conveyance direction of the recording medium P (hereinafter simply referred to as the "width direction"). The holding member 33 is disposed inside the fixing belt 31. The fixing belt 31 is rotatably supported, around a rotation axis extending in the width direction, by the holding member 33, the nip forming member 34 and the guide plate 35.

The pressure roller 32 is in a substantially cylindrical shape having a larger dimension in the width direction. The pressure roller 32 is pressed against the fixing belt 31 by a pressure mechanism (not shown), and a nip part 36 is formed between the fixing belt 31 and the pressure roller 32. The pressure roller 32 is rotatably supported by a fixing frame (not shown). The pressure roller 32 is driven to rotate by a drive mechanism (not shown).

In fixing the toner on the recording medium P, a high-frequency current is applied to the induction coils 39. Accordingly, a magnetic field is generated by the induction coils 39, and owing to the function of the magnetic field, an eddy current is generated in the fixing belt 31 to generate heat in the fixing belt 31. In other words, the fixing belt 31 is heated by the induction coils 39. Besides, owing to the function of the magnetic field, heat is generated in the guide plate 35, and the fixing belt 31 is heated also by the guide plate 35.

The pressure roller 32 is driven to rotate by the drive mechanism (not shown). Accordingly, the fixing belt 31 in pressed contact with the pressure roller 32 is driven to rotate by the rotation of the pressure roller 32. When the fixing belt 31 rotates, the fixing belt 31 slides against the nip forming member 34 (see FIG. 4). Under this state, the recording medium P enters the nip part 36, and the fixing belt 31 having been heated comes into contact with the toner image T not fixed yet on the recording medium P. Then, the toner contained in the toner image T having been transferred onto the recording medium P is heated by the heated fixing belt 31. Thus, the toner is melted, and the fluororesin particles are exposed from the toner particle. Therefore, the toner containing the fluororesin particles disposed on the recording medium P can be inhibited from moving onto the fixing belt 31 through the electrostatic attraction to the fixing belt 31. Incidentally, the unfixed toner image T disposed on the recording medium P is not only heated but also pressed by the pressure roller 32. The unfixed toner image T is fixed on the recording medium P by being heated by the fixing belt 31 and pressed by the pressure roller 32. The recording medium P having passed through the nip part 36 is separated from the fixing belt 31 by the separation plate 38 and is discharged out of the fixing device 30.

Figure 5:
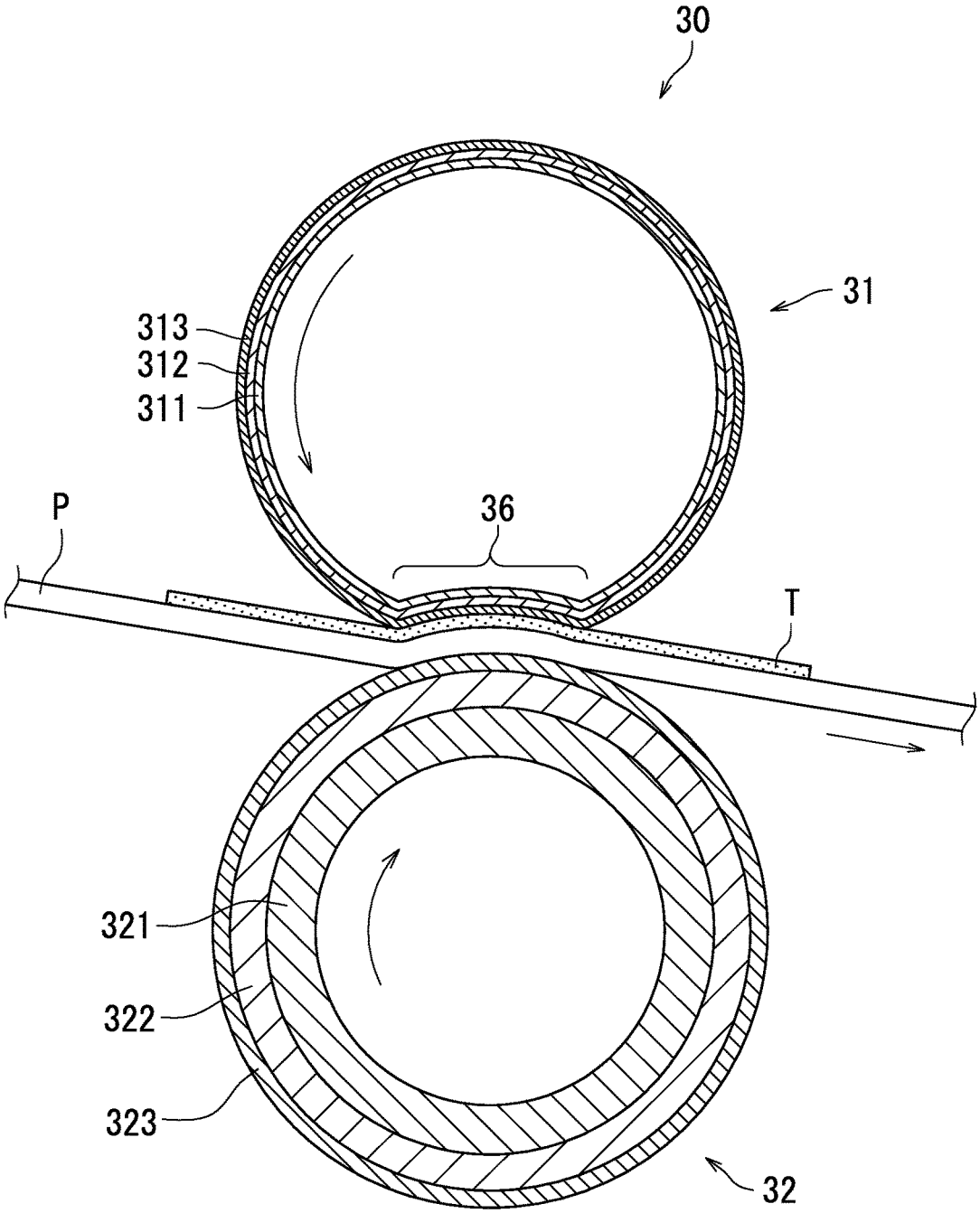
FIG. 5 is a diagram of a fixing belt and a pressure roller illustrated in FIG. 4.

Next, referring to FIG. 5, the fixing belt 31 and the pressure roller 32 will be described in more detail. FIG. 5 illustrates the fixing belt 31 and the pressure roller 32 of FIG. 4. The fixing belt 31 includes a first base layer 311, a first elastic layer 312, and a first release layer 313. The first release layer 313 corresponds to the surface portion of the heating section. The first base layer 311 included in the fixing belt 31 is an endless belt. The first elastic layer 312 is provided on the first base layer 311. The first release layer 313 is provided on the first elastic layer 312. The first base layer 311 is made of, for example, a metal having been subjected to a plating treatment or a rolling treatment (more specifically, electroformed nickel or copper, or the like). The first elastic layer 312 is made of, for example, silicone rubber. The first release layer 313 contains, for example, a fluororesin.

The fixing belt 31 including the first release layer 313 containing the fluororesin tends to have negative chargeability. In fixing a toner image, the fluororesin particles exposed from the toner particle contained in the toner of the first embodiment tend to electrostatically repel the surface of the first release layer 313. Therefore, the toner containing the negatively chargeable fluororesin particles disposed on the recording medium P can be inhibited from moving onto the fixing belt 31 through the electrostatic attraction to the fixing belt 31 having the negative chargeability.

Examples of the fluororesin contained in the first release layer 313 of the fixing belt 31 include PTFE, PFA, polychlorotrifluoroethylene, polyvinylidene fluoride, polyvinyl fluoride, a perfluoroalkoxy fluororesin, an ethylene tetrafluoride-propylene hexafluoride copolymer, an ethylene-ethylene tetrafluoride copolymer, and an ethylene-chlorotrifluoroethylene copolymer.

The fluororesin contained in the first release layer 313 of the fixing belt 31 is preferably the same as the fluororesin contained in the fluororesin particles contained in the toner particle. When the fixing device 30 and the toner contain the same fluororesin, the electrostatic repelling force occurring between the fluororesin particles exposed from the toner particle in fixing and the surface of the first release layer 313 can be further enhanced. As a result, the toner including the fluororesin particles disposed on the recording medium P can be particularly inhibited from moving onto the fixing belt 31 through the electrostatic attraction to the fixing belt 31 of the fixing device 30. Therefore, occurrence of electrostatic offset can be particularly inhibited. The fluororesin contained in the first release layer 313 of the fixing belt 31 is preferably PTFE or PFA, and more preferably PFA. The fluororesin contained in the fluororesin particles contained in the toner particle is preferably PTFE or PFA, and more preferably PFA.

The pressure roller 32 includes a core material 321, a second elastic layer 322, and a second release layer 323. The core material 321 of the pressure roller 32 is in a cylindrical shape. The second elastic layer 322 covers the core material 321. The second release layer 323 covers the second elastic layer 322. The core material 321 is made of a metal such as stainless steel or aluminum. The second elastic layer 322 is made of an elastic member such as silicone rubber or silicone sponge. The second release layer 323 is made of, for example, a fluororesin. The image forming apparatus 100 according to the second embodiment has been described so far.

Third Embodiment: Image Forming Method

Next, referring to FIGS. 3 to 5 again, an image forming method according to a third embodiment of the present disclosure will be described. The image forming method of the third embodiment is a method for forming an image using, for example, the image forming apparatus 100 of the second embodiment.

A preferable example of the image forming method of the third embodiment includes developing, with a developer D, an electrostatic latent image formed on an image bearing member 21 into a toner image T; transferring the toner image T onto a recording medium P; and fixing the transferred toner image T on the recording medium P. The developer D contains the toner of the first embodiment.

A heating section (for example, a fixing belt 31) of a fixing device 30 heats the toner image T having been transferred onto the recording medium P. Through this heating, the toner image T is fixed on the recording medium P. A surface portion (for example, a first release layer 313) of the fixing belt 31 preferably contains the same fluororesin (a fluororesin of the same type) as the fluororesin particles included in the toner particles of the toner of the first embodiment. The surface portion (for example, the first release layer 313) of the fixing belt 31 preferably contains PTFE or PFA, and more preferably contains PFA. The fluororesin particles included in the toner particles included in the toner of the first embodiment preferably contain PTFE or PFA, and more preferably contain PFA.

The image forming method of the third embodiment utilizes the developer D containing the toner of the first embodiment. Therefore, occurrence of electrostatic offset can be inhibited as well as the good positive chargeability can be attained in the image forming method of the third embodiment for the same reason as that described in the first embodiment.

Examples

Now, examples of the present disclosure will be described. Compositions of toners TA-1 to TA-12 and TB-1 to TB-3 of examples and comparative examples are shown in Table 3 below.

In Table 3, "PES" denotes a polyester resin. "SA" denotes a styrene-butyl acrylate copolymer. "PFA" denotes a tetrafluoroethylene-perfluoroalkylvinylether copolymer. "UF" denotes a urea resin. "QA" denotes a thermoplastic resin having a quaternary ammonium cationic group. A ratio in parentheses shown in the column of "Shell Material" corresponds to a ratio of the mass of QA to the mass of SA (mass of QA/mass of SA). The "Amount" of the fluororesin particles corresponds to a content of the fluororesin particles with respect to 100 parts by mass of the binder resin. The amount of the fluororesin particles marked with "(*1)" corresponds, however, to a content of the fluororesin particles with respect to 100 parts by mass of the cores. Besides, the amount of the fluororesin particles marked with "(*2)" corresponds to a content of the fluororesin particles with respect to 100 parts by mass of the toner mother particles. The "Particle diameter" corresponds to a number average primary particle diameter of the fluororesin particles. The symbol "-" shown in the column of the fluororesin particles means that the fluororesin particles were not used. The term "within core" means that the fluororesin particles were positioned within each core. The term "between core and shell" means that the fluororesin particles were positioned between the cores and the shell layers. The term "external addition" means that the fluororesin particles were positioned on the surfaces of the shell layers as an external additive.

Now, a production method for cores A to K to be used for the production of the toners will be described. Besides, production methods for the toners TA-1 to TA-12 and TB-1 to TB-3, a measurement method, an evaluation method and

TABLE 3

| | | Core | | Fluororesin Particle | | | | | |
|---|---|---|---|---|---|---|---|---|---|
| | Toner | Type | Binder Resin | Type | Material | Particle diameter [μm] | Amount [parts by mass] | Position | Shell Material |
| Example 1 | TA-1 | A | PES | P1 | PTFE | 0.30 | 10 | within core | UF |
| Example 2 | TA-2 | B | SA | P1 | PTFE | 0.30 | 10 | within core | UF |
| Example 3 | TA-3 | C | PES | P2 | PTFE | 0.30 | 10 | within core | UF |
| Example 4 | TA-4 | D | PES | P3 | PTFE | 0.20 | 10 | within core | UF |
| Example 5 | TA-5 | E | PES | P4 | PTFE | 0.40 | 10 | within core | UF |
| Example 6 | TA-6 | H | PES | P1 | PTFE | 0.30 | 1 | within core | UF |
| Example 7 | TA-7 | I | PES | P1 | PTFE | 0.30 | 5 | within core | UF |
| Example 8 | TA-8 | J | PES | P5 | PFA | 0.40 | 10 | within core | UF |
| Example 9 | TA-9 | K | PES | P6 | PTFE | 0.02 | 1(*1) | between core and shell | UF |
| Example 10 | TA-10 | A | PES | P1 | PTFE | 0.30 | 10 | within core | QA |
| Example 11 | TA-11 | A | PES | P1 | PTFE | 0.30 | 10 | within core | QA/SA(95/5) |
| Example 12 | TA-12 | A | PES | P1 | PTFE | 0.30 | 10 | within core | QA/SA(70/30) |
| Comparative Example 1 | TB-1 | F | PES | — | — | — | — | — | UF |
| Comparative Example 2 | TB-2 | G | SA | — | — | — | — | — | UF |
| Comparative Example 3 | TB-3 | F | PES | P6 | PTFE | 0.02 | 1 (*2) | external addition | UF |

evaluation results will be described. For evaluation where an error can occur, a considerable number of measurement values for sufficiently reducing the error were obtained, and a number average of the obtained measurement values was used as an evaluation value.

[Preparation of Cores]

<Preparation of Cores A>

An FM mixer ("FM-10B" manufactured by Nippon Coke & Engineering Co., Ltd.) was charged with 100 parts by mass of a polyester resin ("XPE258" manufactured by Mitsui Chemicals, Inc.) used as a binder resin, 5 parts by mass of a polypropylene wax ("660P" manufactured by Sanyo Chemical Industries, Ltd.) used as a release agent, 5 parts by mass of carbon black ("REGAL (registered Japanese trademark) 330R" manufactured by Cabot Corporation) used as a colorant, and 10 parts by mass of fluororesin particles P1 ("KTL-500F" manufactured by Kitamura Limited; detail: PTFE particles, number average primary particle diameter: 0.30 μm) to mix the resultant for 3 minutes at a rotation speed of 2400 rpm. The thus obtained mixture was melt kneaded using a twin-screw extruder ("PCM-30" manufactured by Ikegai Corp.) under conditions of material supply speed of 5 kg/hr., a shaft rotation speed of 150 rpm, and a cylinder temperature of 150° C. The resultant melt kneaded product was cooled. The cooled melt kneaded product was coarsely pulverized using a grinder ("ROTOPLEX (registered Japanese trademark)" manufactured by Hosokawa Micron Corporation). The resultant coarsely pulverized product was finely pulverized using a jet mill ("Ultrasonic Jet Mill I" manufactured by Nippon Pneumatic Mfg. Co., Ltd.). The resultant finely pulverized product was classified using a classifier ("ELBOW JET EJ-LABO" manufactured by Nittetsu Mining Co., Ltd.). As a result, cores A having $D_{50}$ of 7.0 μm were obtained.

<Preparation of Cores B>

Cores B were prepared in the same manner as the cores A except that 100 parts by mass of a styrene-butyl acrylate copolymer ("CPR300" manufactured by Mitsui Chemicals, Inc.) was used instead of 100 parts by mass of the polyester resin ("XPE258" manufactured by Mitsui Chemicals, Inc.). The cores B had $D_{50}$ of 7.0 μm.

<Preparation of Cores C>

Cores C were prepared in the same manner as the cores A except that 10 parts by mass of fluororesin particles P2 ("RUBRON (registered Japanese trademark) L-2" manufactured by Daikin Industries, Ltd., detail: PTFE particles, number average primary particle diameter: 0.30 μm, melting point according to JIS K6891: 328° C.) were used instead of 10 parts by mass of the fluororesin particles P1. The cores C had $D_{50}$ of 7.0 μm.

<Preparation of Cores D>

Cores D were prepared in the same manner as the cores A except that 10 parts by mass of fluororesin particles P3 ("RUBRON L-5" manufactured by Daikin Industries, Ltd., detail: PTFE particles, number average primary particle diameter: 0.20 μm, melting point according to JIS K6891: 328° C.) were used instead of 10 parts by mass of the fluororesin particles P1. The cores D had $D_{50}$ of 7.0 μm.

<Preparation of Cores E>

Cores E were prepared in the same manner as the cores A except that 10 parts by mass of fluororesin particles P4 ("RUBRON L-7" manufactured by Daikin Industries, Ltd., detail: PTFE particles, number average primary particle diameter: 0.40 μm) were used instead of 10 parts by mass of the fluororesin particles P1. The cores E had $D_{50}$ of 7.0 μm.

<Preparation of Cores F>

Cores F were prepared in the same manner as the cores A except that the fluororesin particles P1 were not added. The cores F had $D_{50}$ of 7.0 μm.

<Preparation of Cores G>

Cores G were prepared in the same manner as the cores A except that 100 parts by mass of the styrene-butyl acrylate copolymer ("CPR300" manufactured by Mitsui Chemicals, Inc.) was used instead of 100 parts by mass of the polyester resin ("XPE258" manufactured by Mitsui Chemicals, Inc.), and that the fluororesin particles P1 were not added. The cores G had $D_{50}$ of 7.0 μm.

<Preparation of Cores H>

Cores H were prepared in the same manner as the cores A except that 1 part by mass of the fluororesin particles P1 were used instead of 10 parts by mass of the fluororesin particles P1. The cores H had $D_{50}$ of 7.0 μm.

<Preparation of Cores I>

Cores I were prepared in the same manner as the cores A except that 5 parts by mass of the fluororesin particles P1 were used instead of 10 parts by mass of the fluororesin particles P1. The cores I had $D_{50}$ of 7.0 μm.

<Preparation of Cores J>

A PFA ("NEOFLON (registered Japanese trademark) PFA AP-201" manufactured by Daikin Industries, Ltd., detail: pellet-shaped PFA, melting point according to ASTM D 4591: 301° C.) was pulverized into a number average primary particle diameter of 10 μm using the grinder ("ROTOPLEX" manufactured by Hosokawa Micron Corporation) and the jet mill ("ULTRASONIC JET MILL I" manufactured by Nippon Pneumatic Mfg. Co., Ltd.) to obtain a pulverized product of PFA. The pulverized product of PFA was further pulverized using a bead mill ("ALPHA MILL AM-03L" manufactured by Aimex Co., Ltd.) to obtain fluororesin particles P5 (number average primary particle diameter: 0.4 μm). A cores J were prepared in the same manner as the cores A except that 10 parts by mass of the fluororesin particles P5 were used instead of 10 parts by mass of the fluororesin particles P1. The cores J had $D_{50}$ of 7.0 μm.

<Preparation of Cores K>

Fluororesin particles ("RUBRON PTFE LDW-410" manufactured by Daikin Industries, Ltd., detail: PTFE particles, number average primary particle diameter: 0.20 μm) was pulverized into a number average primary particle diameter of 0.02 μm using the bead mill ("ALPHA MILL AM-03L" manufactured by Aimex Co., Ltd.). The resultant pulverized product was dried to obtain fluororesin particles P6 (detail: PTFE particles, number average primary particle diameter: 0.02 μm).

The cores F (100 parts by mass) obtained as described above in "Preparation of Cores F" and the fluororesin particles P6 (1 part by mass) were mixed using the FM mixer ("FM-10B" manufactured by Nippon Coke & Engineering Co., Ltd.) at a rotation speed of 3500 rpm for 5 minutes. Through this mixing, the fluororesin particles P6 were caused to adhere to the surfaces of the cores F. The cores F having the fluororesin particles P6 adhering to the surfaces thereof were used as cores K.

[Production of Toners]

<Production of Toner TA-1>

First, shell layers were formed on the surface of the cores A. Specifically, a three-necked flask (volume: 1 L) equipped with a thermometer and a stirring blade was charged with 100 g of the cores A, 500 mL of ion-exchanged water, 50 g of sodium polyacrylate (dispersion stabilizer "JURYMER (registered Japanese trademark) AC-103" manufactured by Toagosei Co., Ltd.), and 1 g of methylolated urea ("MIRBANE (registered Japanese trademark) RESIN SUM-100" manufactured by Showa Denko K.K.). Dilute hydrochloric acid was added into the resultant flask to adjust the pH of the contents of the flask to 4. A temperature control tank was used to increase the temperature within the flask to 70° C. With the temperature within the flask kept at 70° C. using the temperature control tank, the contents of the flask were stirred at a rotation speed of 1200 rpm for 1 hour. Thus, a polymerization reaction of the shell material (methylolated urea) was caused on the surfaces of the cores A, so as to form a shell layer made of a urea resin on the surfaces of the cores A. As a result, a dispersion containing toner mother particles MA-1 was obtained. The dispersion was cooled to ordinary temperature (25° C.).

Subsequently, the toner mother particles MA-1 were washed. Specifically, the cooled dispersion containing the toner mother particles MA-1 was subjected to filtration using a Buchner funnel (solid-liquid separation) to obtain the toner mother particles MA-1 in the form of a wet cake. The toner mother particles MA-1 in the form of a wet cake were re-dispersed in ion-exchanged water, and the resultant was filtered through a Buchner funnel. Besides, the re-dispersion and the filtration were repeated five times to wash the toner mother particles MA-1.

Subsequently, the toner mother particles MA-1 were dried. Specifically, the washed toner mother particles MA-1 were dispersed in an ethanol aqueous solution of a concentration of 50% by mass. Thus, a slurry of the toner mother particles MA-1 was obtained. The toner mother particles MA-1 in the slurry were dried using a continuous surface modifying apparatus ("COATMIZER (registered Japanese trademark)" manufactured by Freund Industrial Co., Ltd.) under conditions of a hot air temperature of 45° C. and a blower flow rate of 2 $m^3$/min. As a result, a powder of the toner mother particles MA-1 was obtained.

Then, the toner mother particles MA-1 were subjected to an external addition treatment. Specifically, 100.0 parts by mass of the powder of the toner mother particles MA-1, 0.7 parts by mass of silica particles ("AEROSIL (registered Japanese trademark) RA-200H" manufactured by Nippon Aerosil Co., Ltd., dry silica particles having surfaces modified with a trimethylsilyl group and an amino group, number average primary particle diameter: 12 nm), and 1.0 part by mass of conductive titanium oxide particles ("EC-100" manufactured by Titan Kogyo Ltd., base: titanium oxide particle, coat layer: Sb-doped $SnO_2$ film, volume median diameter ($D_{50}$): 0.35 μm) were mixed using the FM mixer ("FM-10B" manufactured by Nippon Coke & Engineering Co., Ltd.) at a rotation speed of 3500 rpm for 5 minutes. Through this mixing, the external additives (the silica particles and the conductive titanium oxide particles) were caused to adhere to the surfaces of the toner mother particles MA-1. The toner mother particles MA-1 having the external additives adhering thereto were sifted using a 300 mesh sieve (having an opening of 48 μm). In this manner, a positively chargeable toner TA-1 was obtained.

<Production of Toners TA-2 to TA-9 and TB-1 to TB-2>

Toners TA-2 to TA-9 and TB-1 to TB-2 were respectively produced in the same manner as the toner TA-1 except that cores of types shown in Table 3 were respectively used as cores for forming shell layers instead of the cores A. All the toners TA-2 to TA-9 and TB-1 to TB-2 were positively chargeable toners.

<Production of Toner TA-10>

A three-necked flask of a volume of 1 L equipped with a thermometer, a condenser, a nitrogen introducing tube, and a stirring blade was charged with 90 g of isobutanol, 100 g of methyl methacrylate, 35 g of butyl acrylate, 30 g of 2-(methacryloyloxy)ethyl trimethylammonium chloride (manufactured by Alfa Aesar), and 6 g of 2,2'-azobis[2-methyl-N-(2-hydroxyethyl)propionamide] ("VA-086" manufactured by Wako Pure Chemical Industries, Ltd.). Under a nitrogen atmosphere, the temperature within the flask was kept at 80° C. for causing a reaction of the contents of the flask for 3 hours. Then, 3 g of 2,2'-azobis[2-methyl-N-(2-hydroxyethyl)propionamide] ("VA-086" manufactured by Wako Pure Chemical Industries, Ltd.) was added into the flask. Under a nitrogen atmosphere, with the temperature within the flask kept at 80° C., the contents of the flask were reacted for another 3 hours to obtain a polymer solution. The thus obtained polymer solution was dried under conditions of a temperature of 150° C. and a pressure of 0.1 kPa. The dried polymer was crushed to obtain a positively chargeable resin PR-1.

Subsequently, 200 g of the positively chargeable resin PR-1 and 184 mL of ethyl acetate ("Special Grade Ethyl Acetate" manufactured by Wako Pure Chemical Industries, Ltd.) were put in a container of a mixer ("HIVIS MIX (registered Japanese trademark) 2P-1" manufactured by Primix Corporation). The contents of the container were stirred at a rotation speed of 20 rpm for 1 hour to obtain a solution with a high viscosity. Thereafter, an aqueous solution containing ethyl acetate and the like was added to the solution with a high viscosity. The aqueous solution containing ethyl acetate and the like was an aqueous solution obtained by dissolving, in 562 mL of ion-exchanged water, 18 mL of 1N hydrochloric acid, 20 g of a cationic surfactant ("QUARTAMIN (registered Japanese trademark) 24P" manufactured by Kao Corporation, component: lauryltrimethylammonium chloride), and 16 g of ethyl acetate ("Special Grade Ethyl Acetate" manufactured by Wako Pure Chemical Industries, Ltd.). Through the addition of the aqueous solution containing ethyl acetate and the like, a suspension of positively chargeable resin fine particles (particles of a thermoplastic resin having a quaternary ammonium cationic group) having a solid concentration of 30% by mass was obtained. The positively chargeable resin fine particles contained in the thus obtained suspension had a number average primary particle diameter of 35 nm, and a zeta potential at pH 4 of 46 mV. It is noted that a zeta potential was measured using an ultrasonic particle diameter distribution/zeta potential measuring apparatus ("DT-1200" manufactured by Dispersion Technology Inc.).

Subsequently, a three-necked flask with a volume of 1 L equipped with a thermometer and a stirring blade was set in a water bath, and the flask was charged with 100 mL of ion-exchanged water. With the temperature within the flask kept at 30° C. using the water bath, dilute hydrochloric acid was added into the flak to adjust the pH of the contents of the flask to 3. Then, 30 g of the suspension obtained as described above was added into the flask. The cores A (300 g) obtained as described above in <Preparation of Cores A> were further added into the flask. Thereafter, the contents of the flask were stirred at a rotation speed of 200 rpm for 1 hour. Then, 300 mL of ion-exchanged water was added into the flask. While the contents of the flask were being stirred at a rotation speed of 100 rpm, the temperature within the flask was increased up to 70° C. at a rate of 1° C./min. The contents of the flask were stirred for 2 hours under conditions of a temperature of 70° C. and a rotation speed of 100 rpm. Sodium hydroxide was added into the flask to adjust the pH of the contents of the flask to 7. The contents of the flask were cooled to a temperature of 25° C. to obtain a dispersion containing toner mother particles MA-10.

Subsequently, the toner mother particles MA-10 were washed. Specifically, the cooled dispersion containing the toner mother particles MA-10 was subjected to filtration using a Buchner funnel (solid-liquid separation) to obtain the toner mother particles MA-10 in the form of a wet cake. The toner mother particles MA-10 in the form of a wet cake were re-dispersed in ion-exchanged water, and the resultant was filtered through a Buchner funnel. Besides, the re-dispersion and the filtration were repeated five times to wash the toner mother particles MA-10.

Subsequently, the toner mother particles MA-10 were dried. Specifically, the washed toner mother particles MA-10 were dispersed in an ethanol aqueous solution of a concentration of 50% by mass. Thus, a slurry of the toner mother particles MA-10 was obtained. The toner mother particles MA-10 in the slurry were dried using the continuous surface modifying apparatus ("COATMIZER (registered Japanese trademark)" manufactured by Freund Industrial Co., Ltd.) under conditions of a hot air temperature of 45° C. and a blower flow rate of 2 $m^3$/min. As a result, a powder of the toner mother particles MA-10 was obtained.

Then, the toner mother particles MA-10 were subjected to an external addition treatment. Specifically, 100.0 parts by mass of the powder of the toner mother particles MA-10, 0.7 parts by mass of silica particles ("AEROSIL (registered Japanese trademark) RA-200H" manufactured by Nippon Aerosil Co., Ltd., dry silica particles having a surface modified with a trimethylsilyl group and an amino group, number average primary particle diameter: 12 nm), and 1.0 part by mass of conductive titanium oxide particles ("EC-100" manufactured by Titan Kogyo Ltd., base: titanium oxide particle, coat layer: Sb-doped $SnO_2$ film, volume median diameter ($D_{50}$): 0.35 μm) were mixed using the FM mixer ("FM-10B" manufactured by Nippon Coke & Engineering Co., Ltd.) at a rotation speed of 3500 rpm for 5 minutes. Through this mixing, the external additives (the silica particles and the conductive titanium oxide particles) were caused to adhere to the surface of the toner mother particles MA-10. The toner mother particles MA-10 having the external additives adhering thereto were sifted using a 300 mesh sieve (having an opening of 48 μm). In this manner, a positively chargeable toner TA-10 was obtained.

<Production of Toner TA-11>

A positively chargeable toner TA-11 was produced in the same manner as the toner TA-10 except that 190 g of the positively chargeable resin PR-1 and 10 g of the styrene-butyl acrylate copolymer ("CPR300" manufactured by Mitsui Chemicals Inc.) were used as the resin to be put in the container of the mixer ("HIVIS MIX (registered Japanese trademark) 2P-1" manufactured by Primix Corporation) instead of 200 g of the positively chargeable resin PR-1.

<Production of Toner TA-12>

A positively chargeable toner TA-12 was produced in the same manner as the toner TA-10 except that 140 g of the positively chargeable resin PR-1 and 60 g of the styrene-butyl acrylate copolymer ("CPR300" manufactured by Mitsui Chemicals Inc.) were used as the resin to be put in the container of the mixer ("HIVIS MIX (registered Japanese trademark) 2P-1" manufactured by Primix Corporation) instead of 200 g of the positively chargeable resin PR-1.

<Production of Toner TB-3>

Shell layers were formed on the surfaces of the cores F obtained as described above in <Preparation of Cores F>. Specifically, a three-necked flask (volume: 1 L) equipped with a thermometer and a stirring blade was charged with 100 g of the cores F, 500 mL of ion-exchanged water, 50 g of sodium polyacrylate (dispersion stabilizer "JURYMER (registered Japanese trademark) AC-103" manufactured by Toagosei Co., Ltd.), and 1 g of methylolated urea ("MIRBANE (registered Japanese trademark) Resin SUM-100" manufactured by Showa Denko K.K.). Dilute hydrochloric acid was added into the resultant flask to adjust the pH of the contents of the flask to 4. A temperature control tank was used to increase the temperature within the flask to 70° C. With the temperature within the flask kept at 70° C. using the temperature control tank, the contents of the flask were stirred at a rotation speed of 1200 rpm for 1 hour. Thus, a polymerization reaction of the shell material (methylolated urea) was caused on the surfaces of the cores F, so as to form shell layers made of a urea resin on the surfaces of the cores F. As a result, a dispersion containing toner mother particles MB-3 was obtained. The dispersion was cooled to ordinary temperature (25° C.).

Subsequently, the toner mother particles MB-3 were washed. Specifically, the cooled dispersion containing the toner mother particles MB-3 was subjected to filtration using a Buchner funnel (solid-liquid separation) to obtain the toner mother particles MB-3 in the form of a wet cake. The toner mother particles MB-3 in the form of a wet cake were re-dispersed in ion-exchanged water, and the resultant was filtered through a Buchner funnel. Besides, the re-dispersion and the filtration were repeated five times to wash the toner mother particles MB-3.

Subsequently, the toner mother particles MB-3 were dried. Specifically, the washed toner mother particles MB-3 were dispersed in an ethanol aqueous solution of a concentration of 50% by mass. Thus, a slurry of the toner mother particles MB-3 was obtained. The toner mother particles MB-3 in the slurry were dried using a continuous surface modifying apparatus ("COATMIZER (registered Japanese trademark)" manufactured by Freund Industrial Co., Ltd.) under conditions of a hot air temperature of 45° C. and a blower flow rate of 2 $m^3$/min. As a result, a powder of the toner mother particles MB-3 was obtained.

Then, the toner mother particles MB-3 were subjected to an external addition treatment. Specifically, 100.0 parts by mass of the powder of the toner mother particles MB-3, 1.0 part by mass of the fluororesin particles P6 obtained as described above in <Preparation of Cores K>, 0.7 parts by mass of silica particles ("AEROSIL (registered Japanese trademark) RA-200H" manufactured by Nippon Aerosil Co., Ltd., dry silica particles having a surface modified with a trimethylsilyl group and an amino group, number average primary particle diameter: 12 nm), and 1.0 part by mass of conductive titanium oxide particles ("EC-100" manufactured by Titan Kogyo Ltd., base: titanium oxide particle, coat layer: Sb-doped $SnO_2$ film, volume median diameter ($D_{50}$): 0.35 μm) were mixed using the FM mixer ("FM-10B" manufactured by Nippon Coke & Engineering Co., Ltd.) at a rotation speed of 3500 rpm for 5 minutes. Through this mixing, the external additives (the silica particles and the conductive titanium oxide particles) were caused to adhere to the surfaces of the toner mother particles MB-3. The toner mother particles MB-3 having the external additives adhering thereto were sifted using a 300 mesh sieve (having an opening of 48 μm). In this manner, a positively chargeable toner TB-3 was obtained.

[Measurement Method]

<Measurement of Number Average Primary Particle Diameter of Fluororesin Particles>

A toner was dispersed in a cold-setting epoxy resin, and the resultant was cured for 2 days in an atmosphere of 40°

C. to obtain a cured product. The thus obtained cured product was dyed with osmium tetroxide, and cut out using an ultramicrotome equipped with a diamond knife ("EM UC6" manufactured by Leica Microsystems) to obtain a thin sample having a thickness of 200 nm.

The cross-section of the thus obtained thin sample was imaged using a field-emission transmission electron microscope (TEM, "JEM-2100 F" manufactured by JEOL Ltd.) under conditions of an acceleration voltage of 200 kV and a magnification of 1,000,000 to obtain a TEM photograph. TEM photographs of 100 or more resin particles were obtained. Among the TEM photographs thus obtained, TEM photographs of 100 resin particles were randomly selected. In the selected TEM photographs, an equivalent circle diameter of each of the 100 fluororesin particles was measured using image analysis software ("WinROOF" manufactured by Mitani Corporation). A number average value of the equivalent circle diameters of the 100 fluororesin particles was calculated by dividing, by the number of measured particles (100), the sum of the equivalent circle diameters of the 100 fluororesin particles thus measured. The thus calculated number average value was determined as the number average primary particle diameter of the fluororesin particles.

[Evaluation Method and Evaluation Results]

<Preparation of Evaluation Developer>

A two-component developer was prepared by mixing a ferrite carrier and the toner (each of the toners produced as described above) for 30 minutes using a ball mill. A ratio of the toner in the two-component developer was 10% by mass. The ferrite carrier was prepared by coating 1000 parts by mass of a Mn—Mg ferrite core (powder) having a number average primary particle diameter of 35 μm with 230 parts by mass of a resin solution (resin: 30 parts by mass of silicone resin, solvent: 200 parts by mass of toluene) by spraying, and subjecting the resultant to a heat treatment at a temperature of 200° C. for 60 minutes.

<Preparation of Evaluation Apparatus>

A color multifunction peripheral ("TASKalfa 6052ci" manufactured by KYOCERA Document Solutions Inc.) was used as an evaluation apparatus. The evaluation apparatus included a fixing belt (heating section) having a surface portion coated with PFA. The evaluation developer prepared as described above was charged in a black developing device of the evaluation apparatus, a supply toner (toner for evaluation) was charged in a black toner container of the evaluation apparatus.

<Evaluation of Positive Chargeability>

(Measurement of Initial Charge Amount)

An image (coverage rate: 5%) was printed using the evaluation apparatus on one piece of paper (A4 size) under environment of a temperature of 23° C. and a humidity of 50% RH. Subsequently, the two-component developer was taken out of the developing device of the evaluation apparatus. The two-component developer (0.10 g) thus taken out was put in a measurement cell of a Q/m meter ("MODEL 212HS" manufactured by Trek, Inc.). The Q/m meter was used for measuring a charge amount (unit: μC/g) of the toner with the toner alone of the two-component developer sucked through a sieve (wire mesh) for 10 seconds. It is noted that the charge amount of a toner was calculated in accordance with an expression "Charge amount of toner=Total amount of electricity of sucked toner (unit: μC)/Mass of sucked toner (unit: g)". Hereinafter, the charge amount measured after making one copy will be referred to as the "initial charge amount E1" (or simply as "E1").

(Measurement of Charge Amount after Making 10,000 Copies)

An image (coverage rate: 5%) was printed using the evaluation apparatus continuously on 10,000 pieces of paper (A4 size) under environment of a temperature of 23° C. and a humidity of 50% RH. After thus making 10,000 copies, a charge amount (unit: μC/g) of the toner after making 10,000 copies was measured in the same manner as the initial charge amount E1. Hereinafter, the charge amount measured after making 10,000 copies is referred to as the "charge amount E2 after making 10,000 copies" (or simply as "E2").

(Charge Amount Difference)

Based on the initial charge amount E1 and the charge amount E2 after making 10,000 copies, a charge amount difference ΔE (unit: μC/g, hereinafter sometimes simply referred to as the "ΔE") was obtained in accordance with the following expression (A):

$$\text{Charge amount difference } \Delta E = |E1 - E2| \quad \text{(A)}$$

Based on the initial charge amount E1 and the charge amount E2 after making 10,000 copies thus measured and the charge amount difference ΔE, the toner was evaluated for the positive chargeability on the basis of the following criteria:

Good: Conditions of E1 of 15 μC/g or more, E2 of 15 μC/g or more, and ΔE of 5 μC/g or less are all satisfied.

Poor: At least one of conditions of E1 of 15 μC/g or more, E2 of 15 μC/g or more, and ΔE of 5 μC/g or less is not satisfied.

<Evaluation of Electrostatic Offset>

A white image was printed using the evaluation apparatus continuously on 10 pieces of paper (A4 size) under environment of a temperature of 23° C. and a humidity of 50% RH. Subsequently, an image having a coverage rate of 10% was printed on one piece of paper (A4 size). A whiteness meter ("TC-6DS/A" manufactured by Tokyo Denshoku Co., Ltd.) was used to measure a reflection density on a white portion of the paper on which the image with a coverage rate of 10% had been formed. A fogging density was calculated in accordance with an expression "Fogging density= Reflection density on white portion−Reflection density of unprinted paper". Incidentally, if electrostatic offset occurs to cause the toner to adhere to the fixing belt, a toner stain appears on paper every rotation cycle of the fixing belt. When the fogging density exceeded 0.005, it was determined that electrostatic offset had occurred and hence a visually recognizable stain appeared on the paper. Based on the fogging density, electrostatic offset was evaluated on the basis of the following criteria:

Good (electrostatic offset inhibited): FD is 0.005 or less.

Poor (electrostatic offset not inhibited): FD exceeds 0.005.

The measurement results of the initial charge amount E1, the charge amount E2 after making 10,000 copies, and the charge amount difference ΔE of the respective toners are shown in Table 4. The measurement results of the fogging density (FD) of the paper printed using the respective toners are shown in Table 4.

TABLE 4

| | | Evaluation of Positive Chargeability | | | Evaluation of Electrostatic |
|---|---|---|---|---|---|
| | Toner | E1 [μC/g] | E2 [μC/g] | ΔE [μC/g] | Offset FD |
| Example 1 | TA-1 | 22 | 19 | 3 | 0.002 |
| Example 2 | TA-2 | 25 | 24 | 1 | 0.002 |
| Example 3 | TA-3 | 22 | 20 | 2 | 0.003 |
| Example 4 | TA-4 | 24 | 20 | 4 | 0.002 |

TABLE 4-continued

| | Toner | Evaluation of Positive Chargeability | | | Evaluation of Electrostatic |
|---|---|---|---|---|---|
| | | E1 [μC/g] | E2 [μC/g] | ΔE [μC/g] | Offset FD |
| Example 5 | TA-5 | 25 | 23 | 2 | 0.003 |
| Example 6 | TA-6 | 28 | 25 | 3 | 0.005 |
| Example 7 | TA-7 | 26 | 21 | 5 | 0.004 |
| Example 8 | TA-8 | 24 | 20 | 4 | 0.001 |
| Example 9 | TA-9 | 20 | 17 | 3 | 0.002 |
| Example 10 | TA-10 | 22 | 20 | 2 | 0.003 |
| Example 11 | TA-11 | 20 | 17 | 3 | 0.002 |
| Example 12 | TA-12 | 17 | 15 | 2 | 0.002 |
| Comparative Example 1 | TB-1 | 23 | 21 | 2 | 0.009 (poor) |
| Comparative Example 2 | TB-2 | 22 | 20 | 2 | 0.015 (poor) |
| Comparative Example 3 | TB-3 | 17 | 9 (poor) | 8 (poor) | 0.003 |

As shown in Table 3, the fluororesin particles were positioned within the cores or between the cores and the shell layers in each of the toners TA-1 to TA-12. As shown in Table 4, the toners TA-1 to TA-12 satisfied all the conditions of E1 of 15 μC/g or more, E2 of 15 μC/g or more, and ΔE of 5 μC/g or less, and hence had good positive chargeability. As shown in Table 4, the fogging densities of images printed using the toners TA-1 to TA-12 were 0.005 or less, and electrostatic offset was inhibited.

As shown in Table 3, the toner particles did not contain fluororesin particles in each of the toners TB-1 to TB-2. As shown in Table 4, the fogging densities of images printed using the toners TB-1 to TB-2 exceeded 0.005, and electrostatic offset was not inhibited.

As shown in Table 3, the fluororesin particles were externally added in the toner TB-3. In the toner TB-3, the fluororesin particles were positioned neither within the cores nor between the cores and the shell layers. As shown in Table 4, the toner TB-3 had E2 less than 15 μC/g, and ΔE exceeding 5 μC/g, and its positive chargeability was poor.

Based on these results, it was revealed that the toner according to the present disclosure can inhibit occurrence of electrostatic offset as well as attain the good positive chargeability.

Furthermore, as shown in Table 3, in the toner TA-9, 1 part by mass of the fluororesin particles were contained with respect to 100 parts by mass of the cores, and the fluororesin particles were positioned between the cores and the shell layers. In the toner TA-6, 1 part by mass of the fluororesin particles were contained with respect to 100 parts by mass of the binder resin, and the fluororesin particles were positioned within the cores. As shown in Table 4, the fogging density of the image printed using the toner TA-9 was lower than the fogging density of the image printed using the toner TA-6. Thus, it was revealed that when the same amount of the fluororesin particles were used, electrostatic offset can be particularly inhibited by using the toner containing the fluororesin particles positioned between the cores and the shell layers as compared with a case using the toner containing the fluororesin particles positioned within the cores.

Besides, as shown in Table 3, the fluororesin (specifically, PFA) particles contained in the toner particles of the toner TA-8 was the same as the fluororesin (specifically, PFA) contained in the surface portion of the heating section of the fixing device. As shown in Table 4, the fogging density of the image printed using the toner TA-8 was 0.001, which reveals that occurrence of the electrostatic offset was particularly inhibited.

What is claimed is:

1. A positively chargeable toner comprising toner particles, wherein the toner particles each include a core, a shell layer covering a surface of the core, and fluororesin particles, the fluororesin particles are positioned between the core and the shell layer, a content of the fluororesin particles is 0.1% by mass or more and 1.0% by mass or less with respect to a mass of the core, and the shell layer contains a positively chargeable material.

2. The positively chargeable toner according to claim 1, wherein the fluororesin particles contain a tetrafluoroethylene-perfluoroalkylvinylether copolymer, or polytetrafluoroethylene.

3. The positively chargeable toner according to claim 1, wherein the fluororesin particles have a number average primary particle diameter of 0.01 μm or more and 0.50 μm or less.

4. The positively chargeable toner according to claim 1, wherein the positively chargeable material contained in the shell layers is a thermosetting nitrogen-containing resin, or a thermoplastic resin having a quaternary ammonium cationic group.

5. The positively chargeable toner according to claim 1, wherein the toner particles do not contain a positive charge control agent.

6. The positively chargeable toner according to claim 1, wherein the fluororesin particles have a number average primary particle diameter of 0.01 μm or more and 0.05 μm or less.

7. An image forming apparatus, comprising:

an image bearing member;

a developing device configured to develop, with a developer, an electrostatic latent image formed on the image bearing member into a toner image;

a transfer device configured to transfer the toner image onto a recording medium; and a fixing device configured to fix the transferred toner image on the recording medium, wherein the developer contains a positively chargeable toner, the positively chargeable toner includes toner particles, the toner particles each include a core, a shell layer covering a surface of the core, and fluororesin particles, the fluororesin particles are positioned within the core, or between the core and the shell layer, the shall layer contains a positively chargeable material, the fixing device includes a heating section configured to heat the transferred toner image, a surface portion of the heating section contains a tetrafluoroethylene-perfluoroalkylvinylether copolymer, and the fluororesin particles included in the toner particles included in the positively chargeable toner contain a tetrafluoroethylene-perfluoroalkylvinylether copolymer.

8. An image forming method, comprising:

developing, with a developer, an electrostatic latent image formed on an image bearing member into a toner image;

transferring the toner image onto a recording medium; and fixing the transferred toner image on the recording medium, wherein the developer contains a positively chargeable toner, the positively chargeable toner includes toner particles, the toner particles each include a core, a shell layer covering a surface of the core, and fluororesin particles, the fluororesin particles are positioned within the core, or between the core and the shell layer, the shall layer contains a positively chargeable material, the toner image is fixed on the recording medium in the fixing by heating the transferred toner image using a heating section included in a fixing device, a surface portion of the heating section contains a tetrafluoroethylene-perfluoroalkylvinylether copolymer, and the fluororesin particles included in the toner particles included in the positively chargeable toner contain a tetrafluoroethylene-perfluoroalkylvinylether copolymer.

* * * * *